US012735771B2

(12) United States Patent
Meng et al.

(10) Patent No.: US 12,735,771 B2
(45) Date of Patent: Sep. 15, 2026

(54) HIGH-PERFORMANCE COPPER ALLOY TUBE AND PREPARATION METHOD THEREOF

(71) Applicant: ZHEJIANG HAILIANG CO., LTD., Zhuji City (CN)

(72) Inventors: Lei Meng, Zhuji City (CN); Jingbo Gao, Zhuji City (CN); Changming Wu, Zhuji City (CN); Bin Deng, Zhuji City (CN); Haidong Fu, Zhuji City (CN); Luming Feng, Zhuji City (CN); Jianguo Cao, Zhuji City (CN)

(73) Assignee: ZHEJIANG HAILIANG CO., LTD. (CN)

( * ) Notice: Subject to any disclaimer, the term of this patent is extended or adjusted under 35 U.S.C. 154(b) by 0 days.

(21) Appl. No.: 19/403,300

(22) Filed: Nov. 28, 2025

(65) Prior Publication Data

US 2026/0085384 A1 Mar. 26, 2026

(30) Foreign Application Priority Data

Jul. 25, 2025 (CN) ..... 202511029369.X

(51) Int. Cl.
*C22C 9/02* (2006.01)
*C22C 1/02* (2006.01)
*C22F 1/08* (2006.01)

(52) U.S. Cl.
CPC ..... *C22C 9/02* (2013.01); *C22C 1/02* (2013.01); *C22F 1/08* (2013.01)

(58) Field of Classification Search
CPC ..... C22C 9/00; C22C 9/02; C22C 9/06
USPC ..... 420/469, 470, 472, 485, 496, 499, 473
See application file for complete search history.

(56) References Cited

U.S. PATENT DOCUMENTS

| | | | | |
|---|---|---|---|---|
| 5,322,575 | A | 6/1994 | Endo et al. | |
| 2011/0005739 | A1* | 1/2011 | Finney | C22C 9/06 165/177 |
| 2024/0410044 | A1* | 12/2024 | Chen | B22D 11/004 |

FOREIGN PATENT DOCUMENTS

| | | | | | |
|---|---|---|---|---|---|
| CN | 101113499 | A | | 1/2008 | |
| CN | 101171349 | A | | 4/2008 | |
| CN | 101925680 | A | | 12/2010 | |
| CN | 102470471 | A | | 5/2012 | |
| CN | 101469961 | B | | 1/2013 | |
| CN | 103602851 | A | | 2/2014 | |
| CN | 107739880 | A | | 2/2018 | |
| CN | 114134364 | A | * | 3/2022 | C22C 9/06 |
| CN | 115747560 | A | | 3/2023 | |
| CN | 116121585 | A | | 5/2023 | |
| CN | 116219220 | A | | 6/2023 | |
| CN | 116770123 | A | | 9/2023 | |
| CN | 116770124 | A | | 9/2023 | |
| CN | 118497548 | A | | 8/2024 | |
| CN | 120648935 | A | | 9/2025 | |
| EP | 1612285 | A1 | | 1/2006 | |
| JP | S5758423 | B2 | | 12/1982 | |
| JP | H04154942 | A | | 5/1992 | |
| JP | 2000119779 | A | | 4/2000 | |
| JP | 2012149315 | A | | 8/2012 | |
| JP | 2015101754 | A | | 6/2015 | |
| JP | 2015178679 | A | | 10/2015 | |

* cited by examiner

*Primary Examiner* — Patricia L. Hailey

(57) ABSTRACT

The present application discloses a high-performance copper alloy tube and a preparation method thereof. In the present application, a copper alloy tube with high strength, high processing and forming capability, excellent pressure resistance, corrosion resistance, and high-temperature softening resistance is prepared by adding Sn, Ni, and P elements to Cu, adjusting the content and proportion of each element, and introducing a high proportion of Σ3, Σ9, and Σ27 coincidence site lattice grain boundaries in combination with recrystallization treatment process. Meanwhile, elements Zr, Co, and B (optionally) are added on the basis of the above alloy components to further improve the performance of the copper alloy tube. The copper alloy tube of the present application meets the performance requirements of the high pressure-resistant and thin-walled seamless copper tube, and has broad application prospects in the field of heat exchange.

13 Claims, 7 Drawing Sheets

HIGH-PERFORMANCE COPPER ALLOY TUBE AND PREPARATION METHOD THEREOF

TECHNICAL FIELD

This application relates to the field of alloys, and in particular, to a high-performance copper alloy tube and a preparation method thereof.

BACKGROUND ART

Copper material has become a key material in the fields of electronic communication and advanced thermal management, new energy and power transmission, high-end equipment manufacturing and the like due to its excellent thermal conductivity, electrical conductivity, formability and corrosion resistance. Its importance and application scope are continuously increasing with the advancement of technology. Taking the field of heat exchange as an example, as the core material of the refrigeration and air conditioning heat exchanger and the pipeline system, the copper material not only needs to have good processing performance such as bending, flaring, tube expansion, welding, etc., but also needs to have higher strength to meet the increasingly fierce development requirements of high-pressure resistance and thin wall.

The traditional phosphorus-deoxidized copper tube (TP2) has excellent bending, flaring and tube expansion properties. Oxygen removal and improvement of ductility, weldability and corrosion resistance are performed by adding a small amount of P element to electrolytic copper. However, the burst pressure of the TP2 copper tube is low, which cannot meet the safety requirements in the context of developing thin-walled copper tubes with reduced mass.

In order to solve the problem that the burst pressure of the TP2 copper tube is too low, various high-strength copper tubes have been developed in recent years. However, the high-strength copper tubes currently developed mostly contain high contents of Sn, Zn and Ni, and although the copper tubes can meet the requirements of burst pressure after wall reduction to some extent, they generally have the problems of poor formability and insufficient plastic deformation ability (specifically manifested by poor bending, flaring and tube expansion properties).

Patent CN101469961B discloses a copper alloy material containing Sn and P, which contains 0.1~3.0% Sn and 0.005~0.1% P and has a tensile strength of 250 MPa or more. By controlling the proportion of the Goss texture and increasing the proportion of low-angle grain boundaries, the circumferential tensile strength of the copper alloy is enhanced, thereby improving its burst pressure. However, the low-angle grain boundary is essentially the accumulation of dislocations, and if the content of the low-angle grain boundary is too high, the brittleness tendency of the material will be aggravated, the formability will be reduced, and the cold-working properties of the material, such as bending, flaring and tube expansion, will be deteriorated.

Patent CN107739880A discloses a high-strength copper alloy material containing Ni, Sn, and P, which contains 0.3-0.7% Ni, 0.2-1.0% Sn, and 0.01-0.07% P, has a tensile strength of 262-290 MPa, and can be processed into a seamed copper tube by using a rolling welding process. By controlling the elongation after fracture of the copper material within 40%-50%, wrinkling and cracking during the bending process are prevented. However, under this condition, the formability of the copper tube cannot be effectively guaranteed, the risk of flaring and tube expansion is extremely high, and the elongation after fracture is lower than that of the TP2 copper tube.

Therefore, in the current research and development and application of high-strength copper alloys, how to achieve the strength-formability balance of materials has become a technical challenge in the development of copper alloy tubes for heat exchange. Among many indicators for evaluating the performance of copper alloy tubes, yield-to-tensile ratio is a key indicator for measuring the balance between material strength and formability. Generally speaking, a low yield-to-tensile ratio indicates that the material has a relatively low yield strength while having a relatively high tensile strength, which makes the material have excellent uniform deformability and low resilience, facilitates processing and deformation, and can withstand a relatively high damage stress, thereby resolving the problem that high strength is difficult to be compatible with excellent formability.

The yield-to-tensile ratio of the TP2 copper tube is generally between 0.30 and 0.35, while the yield-to-tensile ratio of the high-strength copper tube is generally between 0.4 and 0.6, which makes the high-strength copper tube significantly inferior to the TP2 copper tube in terms of bending, flaring and expanding. In order to solve the problem of the balance between the strength and formability of high-strength copper alloy materials, it is necessary to develop new high-performance copper tubes with the research and development goals of high strength and low yield-to-tensile ratio to adapt to the development trend of lightweight and compactness of modern refrigeration equipment.

It should be noted that, in the thin-wall application scenario, the copper tube also faces two major technical challenges: firstly, the reduction in wall thickness will significantly shorten the ant-nest corrosion resistance life, and the thinner the wall, the more severe the detrimental effect. Moreover, at a bent portion with residual stress, the stress corrosion effect further accelerates the corrosion process. In addition, the high-temperature softening phenomenon in the brazing process is more prominent, the burst pressure drop of the heat-affected zone of the thin-walled copper tube can reach 15-30%, and the thinner the wall, the higher the risk of over-burning, and the more serious the deterioration of the pressure resistance performance.

Based on the above problems, it is necessary to develop a high-performance copper alloy tube, which has high tensile strength, low yield-to-tensile ratio, excellent ant-nest corrosion resistance performance and high-temperature softening resistance, so as to solve the problem of poor formability of the existing high-strength copper tube, meet the requirements for high corrosion resistance and high-temperature softening resistance of copper alloy materials in the background of thin-walled development, and promote the development of heat exchange materials in the directions of high efficiency, energy saving and green and low carbon.

SUMMARY OF THE INVENTION

An object of the present application is to provide a high-performance copper alloy tube and a preparation method thereof. By designing the composition of the copper alloy and combining with an improved recrystallization process, the copper alloy tube has excellent corrosion resistance and high-temperature softening resistance while having high strength and good formability, and can overcome numerous issues associated with existing copper alloy tubes used in heat exchange applications.

The design idea of the present application is as follows: The copper alloy tube designed in the present application has both high tensile strength and low yield-to-tensile ratio to meet the requirements for high pressure resistance and excellent formability of copper materials in the field of heat exchange. The present application primarily reduces the yield-to-tensile ratio of the copper material by increasing its tensile strength while maintaining essentially unchanged yield strength, which requires the copper material to meet the following requirements: (1) the copper material has a single face-centered cubic (FCC) crystal structure phase, and no hard brittle phase precipitates; (2) the copper material has an appropriate grain size; and (3) the copper material has a high proportion of low-Σ value coincidence site lattice grain boundaries.

The low-Σ value coincidence site lattice grain boundary has the characteristics of low-energy and coherence, and has a lower ability to hinder dislocations in the early stage of deformation than the random high-angle grain boundary, which helps restrict the increase in yield strength. With the progress of plastic deformation, dislocations gradually accumulate at the interface, and the subsequent dislocation motion is hindered by the elastic strain field of preceding dislocations, thereby strengthening the dislocation storage capacity, resulting in an increase in flow stress, which is manifested as an increase in strain hardening rate, so that the copper alloy has higher tensile strength, thereby achieving a low yield-to-tensile ratio.

The low-Σ value coincidence site lattice grain boundary has poor mobility, which can prevent the abnormal grain growth in copper alloy tubes during the process of welding the tube, thereby improving their high-temperature softening resistance.

Compared with the random high-angle grain boundary, the low-Σ value coincidence site lattice grain boundary is purer, the coherent nature of the low-Σ value coincidence site lattice grain boundary makes it difficult to accommodate solute atoms, resulting in lower susceptibility to intergranular corrosion. Furthermore, an increased proportion of (Σ9+Σ27)/Σ3 can effectively reduce the connectivity of the random high-angle grain boundary network, hindering the propagation of intergranular corrosion along grain boundaries, which is conducive to alleviating the problem that the intergranular corrosion accelerates the ant-nest corrosion, thereby improving the corrosion resistance life.

In the present application, the copper alloy is strengthened by a multi-element composite trace addition method, and the proportion and addition amount of each element are controlled to prevent the copper alloy from precipitating hard and brittle phases, so that the copper alloy has a single face-centered cubic crystal structure α phase; at the same time, the stacking fault energy of the alloy system is reduced, so that the copper alloy has a thermodynamic condition of forming a high-proportion low-Σ value coincidence site lattice grain boundary, and on this basis, a high-proportion low-Σ value coincidence site lattice grain boundary is introduced in combination with the recrystallization process; and in the present application, the grain size of the copper alloy is also controlled by adjusting the annealing process, so as to obtain a copper alloy tube with high strength, low yield-to-tensile ratio, corrosion resistance and high-temperature softening resistance.

A first aspect of the present application provides a high-performance copper alloy tube, consisting of the following components in mass percentage: 0.05%≤Sn≤0.6%, 0.08%≤Ni<0.3%, 0.015%≤P≤0.045%, and the balance being Cu and unavoidable impurities; and f1=[S]+10 [P], f2=[S]/[Ni], f1 and f2 satisfying: 0.5%≤f1≤1.05%, 1<f2≤5, wherein [Sn], [P] and [Ni] represent the mass percentage content of Sn, P and Ni, respectively;

the copper alloy tube has a single face-centered cubic crystal structure α phase; the average grain size excluding twin boundaries is 10-25 μm, and the average grain size including twin boundaries is 5-20 μm; the total proportion of Σ3, Σ9, and Σ27 coincidence site lattice grain boundaries in the copper alloy tube is ≥50%, and the ratio of the proportions of Σ9 and Σ27 coincidence site lattice grain boundaries to that of Σ3 coincidence site lattice grain boundaries satisfies: (Σ9+Σ27)/Σ3≥3.5%.

In the present application, the Sn element can be solid dissolved in a large amount in the Cu matrix, without precipitating a second phase by trace addition.

In the present application, the Sn element can improve the strength of the copper alloy tube by solid solution strengthening. The solid solution strengthening effect of the alloy element on the copper alloy tube mainly depends on the lattice mismatch coefficient and the shear modulus mismatch coefficient between the solute atoms and the matrix atoms, and the larger the two mismatch coefficients, the stronger the solid solution strengthening effect. The atomic radius difference between Sn and Cu is 23.4%, and the increase in shear modulus of the Cu matrix due to Sn is approximately 1.35 GPa/at. %. This indicates that both mismatch coefficients between Sn and Cu are significant, resulting in a strong solid solution strengthening effect on the Cu matrix. Therefore, the addition of Sn enables effective solid solution strengthening.

In the present application, the Sn element can effectively reduce the stacking fault energy of the copper alloy system, thereby forming a large number of stacking faults during the recrystallization process, and these stacking faults serve as nucleation sites for annealing twins and develop into complete annealing twins through atomic rearrangement. The annealing twin boundaries will also meet with random high-angle grain boundaries during the migration process, and react to generate a large number of low-Σ value coincidence site lattice grain boundaries (Σ3, 29, and Σ27 coincidence site lattice grain boundaries, wherein Σ27 is further categorized into Σ27a and Σ27b), thereby consuming random high-angle grain boundaries and increasing the proportion of low-Σ value coincidence site lattice grain boundaries.

It should be noted that when the amount of Sn element added is too small, its effects on reducing the stacking fault energy and enhancing solid solution strengthening of the alloy are both insignificant. However, excessive Sn addition will lead to the precipitation of the hard and brittle δ phase ($Cu_{41}Sn_{11}$), as well as micro-segregation of Sn element and grain boundary segregation, thereby resulting in a decrease in intergranular bonding force and deterioration of the hot workability of the alloy. Therefore, in the present application, the content of the Sn element is controlled within the range of 0.05%≤Sn≤0.6%, and phenomena such as hard and brittle & phase precipitation, reduced intergranular bonding force, deterioration of hot workability and the like are avoided while introducing a high proportion of low-Σ value coincidence site lattice grain boundaries and improving the solid solution strengthening ability of the alloy.

Therefore, by adding the Sn element, the present application achieves solid solution strengthening of the copper alloy and reduces the stacking fault energy of the alloy system to introduce a high proportion of low-Σ value coincidence site lattice grain boundaries. This enables the copper alloy tube to possess both high strength and a low yield-to-tensile ratio, thereby achieving a high degree of coordination between high strength and excellent formability, while also enhancing corrosion resistance and high-temperature softening resistance to a certain extent.

In the present application, the ant-nest corrosion resistance of the Cu matrix is improved by adding Ni element. The Ni ions can fill the defects of the cuprous oxide film layer on the surface of the copper alloy, so that the oxide layer on the surface of the copper alloy is more stable and denser, thereby reducing the ant-nest corrosion rate of the copper alloy, and with the increase of the Ni content, the ant-nest corrosion resistance of the copper alloy is improved accordingly.

In the present application, Ni and Cu have the same crystal form and have infinite solid solution characteristics, thereby avoiding the precipitation of the brittle second phase with the effect of deteriorating ductility.

In the present application, Ni element also has a certain solid solution strengthening effect. However, the atomic radius difference between Ni and Cu is only 3.2%, and the increase in shear modulus of the Cu matrix due to Ni is merely 0.19 GPa/at. %. Both mismatch coefficients are much lower than those of Sn, resulting in a limited solid solution strengthening effect. Therefore, Ni only serves as a supplement to Sn for strengthening the copper alloy.

It should be noted that the addition of Ni element will slightly increase the stacking fault energy of the alloy system, which is unfavorable for introducing low-Σ value coincidence site lattice grain boundaries, that is, it is detrimental to reducing the yield-to-tensile ratio of the copper alloy. Therefore, the addition amount of Ni element should not be excessively high, and the ratio of Sn to Ni should be controlled to ensure a high proportion of the low-Σ value coincidence site lattice grain boundaries.

Therefore, in order to significantly enhance the ant-nest corrosion resistance of the copper alloy while maintaining its yield-to-tensile ratio, ductility, and processing properties such as bending, flaring, and tube expansion, the present application controls the Ni content within the range of $0.08\% \leq Ni < 0.3\%$.

In the present application, the ant-nest corrosion resistance of copper alloy is improved by adding Ni element, and the high synergy between mechanical properties and corrosion resistance is achieved by the composite addition of Sn and Ni elements. Among them, the Ni element makes up for the problem that the Sn element cannot significantly improve the ant-nest corrosion resistance of copper alloy thin-walled tubes, and the Sn element makes up for the negative problem that the Ni element improves the stacking fault energy of the alloy system.

In the present application, the trace addition of P element not only has the function of deoxidizing copper liquid, but also can further reduce the stacking fault energy of the alloy system by means of P element. The stacking fault energy reduction effect of P element is stronger than that of Sn element, which can compensate for the problem of limited reduction of stacking fault energy caused by the limited content of Sn element to some extent. At the same time, P element can also improve the fluidity of copper liquid, compensating for the problem of Sn element reducing the fluidity of copper liquid.

It should be noted that the maximum solid solubility of P element is relatively low, and excessive addition will form a Cu3P phase, which may segregate at grain boundaries and deteriorate the ductility of copper alloys. Therefore, the present application limits the addition amount of P element and controls it within $0.015\% \leq P \leq 0.045\%$.

In the present application, by the weighted control of the total addition amount of Sn and P elements and the ratio of Sn to Ni elements, the f1 value is ≥0.5% and the f2 value is >1, so that the alloy has a certain low stacking fault energy, and at the same time, in cooperation with the subsequent recrystallization process, the proportion of the low-Σ value coincidence site lattice grain boundaries is ≥50%, thereby achieving high strength and low yield-to-tensile ratio. Furthermore, the ratio of $(\Sigma 9+\Sigma 27)/\Sigma 3$ is controlled to be ≥3.5% to provide a measurable improvement in corrosion resistance. In addition, the present application controls $f1 \leq 1.05$ and $f2 \leq 5$ to prevent scenarios where excessive additions of Sn element and total elements cause the solute atom concentration in the matrix to exceed a certain limit. Beyond this limit, the pinning spacing becomes excessively small, severely impairing the deformability of the matrix and compromising the maintenance of a low yield-to-tensile ratio. By controlling the upper limits of f1 and f2 values, it is also beneficial to make the copper alloy of the present application have a single face-centered cubic crystal structure α phase.

The copper alloy tube has a single face-centered cubic crystal structure α phase, which can avoid micro-crack initiation caused by uncoordinated deformation of the matrix and the second phase. At the same time, the face-centered cubic crystal structure phase possesses numerous slip systems and strong plastic deformation capability, and is not prone to stress concentration, which is conducive to promoting plastic deformation and maintaining low yield strength, and provides the microstructural foundation for achieving a low yield-to-tensile ratio.

According to the Hall-Petch relationship, grain refinement can improve the interface area, increase the resistance to dislocation motion, and improve yield strength and tensile strength to some extent. The present application controls the average grain size excluding twin boundaries within the range of 10-25 μm to maintain no excessive increase in yield strength. The twin boundaries divide the original grains to further reduce the grain size, but they have the characteristics of low-energy and coherence, and have a small increase in yield strength, while effectively avoiding strain concentration and significantly enhancing the strain hardening capacity. However, the average grain size including twin boundaries should not be too low, otherwise it can also cause the increase of yield strength. Therefore, in the present application, the average grain size including twin boundaries is controlled within the range of 5-20 μm to maintain a lower yield strength, while providing adequate strain hardening capacity, thereby promoting the enhancement of tensile strength.

In the present application, the proportion of Σ3, Σ9, and Σ27 coincidence site lattice grain boundaries is controlled to be 50% or more to achieve high strength and low yield-to-tensile ratio, improve the processing deformation ability of the alloy, and control the ratio of $(\Sigma 9+\Sigma 27)/\Sigma 3$ to be ≥3.5% to improve the corrosion resistance of the alloy.

By controlling the element composition and ratio, and microstructural parameters within the aforementioned ranges, the present application has the following results: the prepared copper alloy tube has a yield strength of 60-90 MPa, a tensile strength ≥260 MPa, a yield-to-tensile ratio of 0.23-0.30, and an elongation after fracture ≥50%, the burst pressure is increased by ≥7% compared with TP2 copper tubes of the same specification, the wall thickness can be reduced by ≥10% while maintaining the burst pressure unchanged, and the burst pressure decay rate after tube welding is ≤10%. After alternating hot and cold corrosion tests for 21 days in an atmosphere of 0.4% formic acid aqueous solution, a maximum corrosion depth of a single tube is ≤170 μm, and a maximum corrosion depth at a bent portion is ≤190 μm. Compared with TP2 copper tubes of the same specification, the ant-nest corrosion resistance of single tubes is improved by 15% or more, while the corrosion resistance decay rate at a bent portion is ≤15%.

A second aspect of the present application provides a high-performance copper alloy tube, consisting of the following components in mass percentage: 0.05%≤Sn≤0.6%, 0.08%≤Ni<0.3%, 0.015%≤P≤0.045%, and the balance being Cu and unavoidable impurities; and f1=[Sn]+10 [P], f2=[Sn]/[Ni], f1 and f2 satisfying: 0.5%≤f1≤1.05%, 1<f2≤5, wherein [Sn], [P] and [Ni] represent the mass percentage content of Sn, P and Ni, respectively;

the copper alloy tube has a single face-centered cubic crystal structure α phase; the average grain size excluding twin boundaries is 10-25 μm, and the average grain size including twin boundaries is 5-20 μm; the total proportion of Σ3, Σ9, and Σ27 coincidence site lattice grain boundaries in the copper alloy tube is ≥68%, and the ratio of the proportions of Σ9 and Σ27 coincidence site lattice grain boundaries to that of Σ3 coincidence site lattice grain boundaries satisfies: (Σ9+Σ27)/Σ3≥10%.

In the present application, by adjusting the single recrystallization process to the repeated recrystallization process on the basis of keeping the chemical composition and content unchanged, the total proportion of Σ3, Σ9, and Σ27 coincidence site lattice grain boundaries as well as the (Σ9+Σ27)/Σ3 ratio in the copper alloy are further improved, which enable to further improve the strength, corrosion resistance and high-temperature softening resistance of the material and reduce the yield-to-tensile ratio.

By controlling the element composition and ratio, and microstructural parameters within the aforementioned ranges, the present application has the following results: the prepared copper alloy has a yield strength of 65-90 MPa, a tensile strength ≥285 MPa, a yield-to-tensile ratio of 0.21-0.28, and an elongation after fracture ≥50%, the burst pressure is increased by ≥20% compared with TP2 copper tubes of the same specification, the wall thickness can be reduced by ≥18% while maintaining the burst pressure unchanged, and the burst pressure decay rate after tube welding is ≤5%. After alternating hot and cold corrosion tests for 21 days in an atmosphere of 0.4% formic acid aqueous solution, a maximum corrosion depth of a single tube is ≤155 μm, and a maximum corrosion depth at a bent portion is ≤165 μm. Compared with TP2 copper tubes of the same specification, the ant-nest corrosion resistance of single tubes is improved by 20% or more, while the corrosion resistance decay rate at a bent portion is ≤10%.

For the high-performance copper alloy tubes of the first and second aspects of the present application, preferably, in the copper alloy tube, f1 and f2 satisfy: 0.65%≤f1≤1.05%, 3.4≤f2≤5.

By further increasing the f1 and f2 values and increasing the content of solid solution elements, the present application can further improve the tensile strength, reduce the stacking fault energy of the alloy system, achieve the improvement of the proportion of low-Σ value coincidence site lattice grain boundaries and the (Σ9+Σ27)/Σ3 value, and maintain the low yield-to-tensile ratio, thereby reducing the burst pressure decay rate and the corrosion resistance decay rate at a bent portion to a certain extent.

Taking the single recrystallization process as an example, by controlling the f1 and f2 values within the aforementioned ranges, the resulting copper alloy of the present application still possesses a single face-centered cubic crystal structure α phase. Its average grain size excluding twin boundaries is 10-25 μm, while the average grain size including twin boundaries is 5-20 μm, thereby providing the microstructural foundation for achieving a low yield-to-tensile ratio. At the same time, by further increasing the f1 and f2 values, the present application can increase the proportion of low-Σ value coincidence site lattice grain boundaries to ≥60% and the (Σ9+Σ27)/Σ3 ratio to ≥3.8%. As a result, the prepared copper alloy has a yield strength of 65-90 MPa, a tensile strength ≥270 MPa, a yield-to-tensile ratio of 0.23-0.30, and an elongation after fracture ≥50%, the burst pressure is increased by ≥13% compared with copper tubes of the same specification, the wall thickness can be reduced by ≥14% while maintaining the burst pressure unchanged, and the burst pressure decay rate after tube welding is ≤7%. After alternating hot and cold corrosion tests for 21 days in an atmosphere of 0.4% formic acid aqueous solution, a maximum corrosion depth of a single tube is ≤165 μm, and a maximum corrosion depth at a bent portion is ≤180 μm. Compared with TP2 copper tubes of the same specification, the ant-nest corrosion resistance of single tubes is improved by 17% or more, while the corrosion resistance decay rate at a bent portion is ≤12%.

A third aspect of the present application provides a high-performance copper alloy tube, consisting of the following components in mass percentage: 0.05%≤Sn≤0.6%, 0.08%≤Ni<0.3%, 0.015%≤P≤0.045%, 0.001%≤Zr<0.03%, 0.001%≤Co<0.01%, 0≤B<0.01%, and the balance being Cu and unavoidable impurities; and f1=[Sn]+10 [P]+10 [Zr], f2=[Sn]/[Ni], f1 and f2 satisfying: 0.65%≤f1<1.15%, 1<f2≤5, wherein [Sn], [P], [Zr], and [Ni] represent the mass percentage content of Sn, P, Zr and Ni, respectively;

the copper alloy tube has a single face-centered cubic crystal structure α phase; the average grain size excluding twin boundaries is 10-25 μm, and the average grain size including twin boundaries is 5-20 μm; the total proportion of Σ3, Σ9, and Σ27 coincidence site lattice grain boundaries in the copper alloy tube is ≥60%, and the ratio of the proportions of Σ9 and Σ27 coincidence site lattice grain boundaries to that of Σ3 coincidence site lattice grain boundaries satisfies: (Σ9+Σ27)/Σ3≥4.0%.

On the basis of Sn, Ni and P composite reinforced copper alloy, the present application further reduces the stacking fault energy of the alloy system by adding Zr element, significantly increases the proportion of low-Σ value coincidence site lattice grain boundaries, and realizes further improvement of the strength and reduction of the yield-to-tensile ratio; and specifically improves the high-temperature softening resistance of the copper alloy by adding Co element, and significantly reduces the burst pressure decay rate of the copper tube after welding. At the same time, B element is optionally added to specifically improve the quality of the cast blank, reduce the oxygen content, and further enhance the corrosion resistance of the finished copper tube.

Specifically, in the present application, the trace addition of Zr element further reduces the stacking fault energy of the copper alloy system, thereby activating a higher proportion of stacking faults and forming a higher proportion of low-Σ value coincidence site lattice grain boundaries, so that the performance of the copper alloy is further optimized. The effect of the Zr element in reducing the stacking fault energy is much stronger than that of the Sn and P elements. The Zr element can not only reduce the stacking fault energy to a lower level together with the Sn and P elements, but also replace the Sn element to a certain extent, thereby reducing the amount of Sn element used and improving the economy of the alloy.

It should be noted that Zr has very limited solid solubility in Cu matrix. According to the Cu—Zr binary phase diagram, the maximum solid solubility of Zr in Cu at room temperature is less than 0.11%, and in practical applications, the content of Zr should be reduced to 0.03% or less to prevent the precipitation of brittle Zr-containing second phase. Therefore, in order to ensure that the Zr element can significantly reduce the stacking fault energy while preventing the precipitation of brittle Zr-containing second phase, the present application strictly controls the addition amount of Zr element to be 0.001%≤Zr<0.03%.

In the present application, the Co element significantly increases the recrystallization temperature of the copper alloy due to its high melting point characteristic, and also has the function of pinning random high-angle grain boundaries, effectively restricting their rapid migration during welding and suppressing abnormal grain growth. This contributes to enhancing the high-temperature softening resistance of the copper alloy. However, the solid solubility of Co element in Cu matrix is also extremely low. Therefore, in order to improve the high-temperature softening resistance and maintain a single face-centered cubic crystal structure phase, the present application controls the addition amount of Co element to be 0.001%≤Co<0.01%.

In the present application, B element has a dual function of removing oxygen from copper liquid and refining the dendritic structure of the cast blank. The B element reacts with cuprous oxide and free oxygen in the copper liquid to generate diboron trioxide, which forms slag and floats up to achieve the effect of oxygen removal. However, the maximum solid solubility of the B element in the Cu matrix at room temperature is only 0.01%, therefore, to achieve deoxidation and grain refinement while maintaining a single face-centered cubic crystal structure phase, the addition amount of the B element in the present application is controlled to be lower than 0.01%.

In the present application, the total addition amount of Sn, P and Zr elements, the ratio of Sn to Ni elements, and the individual addition amount of Co and B elements are controlled by weighting, so that f1≥0.65% and f2>1, the strong stacking fault energy-reducing effect of Zr is utilized to further decrease the stacking fault energy or reduce the Sn element addition amount. Combined with subsequent recrystallization process, the proportion of low-Σ value coincidence site lattice grain boundaries is increased to ≥60%, thereby enhancing strength while maintaining a low yield-to-tensile ratio. Additionally, the (Σ9+Σ27)/Σ3 ratio is raised to ≥4.0%, which contributes to improved corrosion resistance. At the same time, the present application enables the copper alloy to maintain a single α phase by controlling the amount of each element added separately and making the f1 value<1.15%, f2≤5.

By controlling the element composition and ratio, and microstructural parameters within the aforementioned ranges, the present application achieves the following results: the prepared copper alloy has a yield strength of 65-90 MPa, a tensile strength ≥275 MPa, a yield-to-tensile ratio of 0.22-0.29, and an elongation after fracture ≥50%, the burst pressure is increased by ≥18% compared with TP2 copper tubes of the same specification, the wall thickness can be reduced by ≥15% while maintaining the burst pressure unchanged, and the burst pressure decay rate after tube welding is ≤6%. After alternating hot and cold corrosion tests for 21 days in an atmosphere of 0.4% formic acid aqueous solution, a maximum corrosion depth of a single tube is ≤165 μm, and a maximum corrosion depth at a bent portion is ≤180 μm. Compared with TP2 copper tubes of the same specification, the ant-nest corrosion resistance of single tubes is improved by 18% or more, while the corrosion resistance decay rate at a bent portion is ≤11%.

Preferably, in the copper alloy of the present application, 0.001%≤B<0.01% by mass percentage.

In the present application, by controlling the content of B within the above range, the oxygen content in the copper alloy can be reduced to 15 ppm or less while refining the dendritic structure of the cast blank, thereby improving its ant-nest corrosion resistance. After adding the B element, after alternating hot and cold corrosion tests for 21 days in an atmosphere of 0.4% formic acid aqueous solution, a maximum corrosion depth of a single tube is ≤155 μm, and a maximum corrosion depth at a bent portion is ≤170 μm. Compared with TP2 copper tubes of the same specification, the ant-nest corrosion resistance of single tubes is improved by 21% or more, while the corrosion resistance decay rate at a bent portion is ≤10%.

A fourth aspect of the present application provides a high-performance copper alloy tube, consisting of the following components in mass percentage: 0.05%≤Sn≤0.6%, 0.08%≤Ni<0.3%, 0.015%≤P≤0.045%, 0.001%≤Zr<0.03%, 0.001%≤Co<0.01%, 0≤B<0.01%, and the balance being Cu and unavoidable impurities; and f1=[Sn]+10 [P]+10 [Zr], f2=[Sn]/[Ni], f1 and f2 satisfying: 0.65%≤f1<1.15%, 1<f2≤5, wherein [Sn], [P], [Zr], and [Ni] represent the mass percentage content of Sn, P, Zr and Ni, respectively;

the copper alloy tube has a single face-centered cubic crystal structure α phase; the average grain size excluding twin boundaries is 10-25 μm, and the average grain size including twin boundaries is 5-20 μm; the total proportion of Σ3, 29, and Σ27 coincidence site lattice grain boundaries in the copper alloy tube is ≥72%, and the ratio of the proportions of Σ 9 and Σ27 coincidence site lattice grain boundaries to that of Σ3 coincidence site lattice grain boundaries satisfies: (Σ9+Σ27)/Σ3≥12%.

In the present application, on the basis of the above alloy element combination addition, in combination with the repeated recrystallization process, the total proportion of Σ3, Σ9 and Σ27 grain boundaries of the alloy is further improved, (Σ9+Σ27)/Σ3≥12%, which enable to maintain a sufficiently low yield-to-tensile ratio while improving the strength, and effectively reduce the burst pressure decay rate and the corrosion resistance decay rate at a bent portion after tube welding.

By controlling the element composition and ratio, and microstructural parameters within the aforementioned ranges, the present application has the following results: the prepared copper alloy tube has a yield strength of 65-90 MPa, a tensile strength ≥295 MPa, a yield-to-tensile ratio of 0.20-0.27, and an elongation after fracture ≥50%, the burst pressure is increased by ≥25% compared with TP2 copper tubes of the same specification, the wall thickness can be reduced by ≥20% while maintaining the burst pressure unchanged, and the burst pressure decay rate after tube welding is ≤2%. After alternating hot and cold corrosion tests for 21 days in an atmosphere of 0.4% formic acid aqueous solution, a maximum corrosion depth of a single tube is ≤150 μm, and a maximum corrosion depth at a bent portion is ≤160 μm. Compared with TP2 copper tubes of the same specification, the ant-nest corrosion resistance of single tubes is improved by 23% or more, while the corrosion resistance decay rate at a bent portion is ≤7%.

Preferably, on the basis of the above repeated recrystallization process, by controlling the content of B element to be 0.001%≤B<0.01%, the oxygen content of the copper alloy can be reduced to 15 ppm or less, so that after alternating hot and cold corrosion tests for 21 days in an atmosphere of 0.4% formic acid aqueous solution, a maximum corrosion depth of a single tube is ≤145 μm, and a maximum corrosion depth at a bent portion is ≤155 μm. Compared with TP2 copper tubes of the same specification, the ant-nest corrosion resistance of single tubes is improved by 25% or more, while the corrosion resistance decay rate at a bent portion is ≤5%.

A fifth aspect of the present application provides a preparation method of the high-performance copper alloy tube, which can prepare a copper alloy seamless tube, and the method can be implemented by using an existing production line and has strong adaptability to existing equipment.

Specifically, the preparation method of the high-performance copper alloy tube of the present application comprises the following steps: batching and smelting→continuous casting→rolling→combined drawing→recrystallization treatment; wherein,

- batching and smelting: smelting the raw materials meeting the content and ratio;
- continuous casting: continuously casting a molten liquid to obtain a billet;
- rolling: rolling the billet to obtain a rolled tube blank;
- combined drawing: reducing the diameter of the rolled tube blank;
- recrystallization treatment: obtaining a product with target properties by controlling the deformation amount and annealing parameters.

In the present application, on the basis of the design of alloying components and contents, the proportion of the low-Σ value coincidence site lattice grain boundaries is improved by improving the recrystallization process. The recrystallization process can be categorized into single recrystallization process and repeated recrystallization process. The essence of both recrystallization processes is to increase the proportion of low-Σ value coincidence site lattice grain boundaries formed by strain induced grain boundary migration.

Preferably, the recrystallization treatment is a single recrystallization process, which is "block drawing→final annealing" with a total deformation amount of block drawing not less than 80%, a final annealing temperature of 500-750° C., and an annealing time of 30-150 min.

In the present application, the single recrystallization process has a large deformation and a higher annealing temperature. During the annealing process, a large number of strain-induced annealing twins will be formed due to the low stacking fault energy of the alloy system, and the formed annealing twin boundaries (Σ3) will also meet with the random high-angle grain boundaries during the migration process, reacting to generate a large number of low-Σ value coincidence site lattice grain boundaries (Σ3, Σ9, Σ27a and Σ27b), thereby increasing the proportion of low-Σ value coincidence site lattice grain boundaries. Among them, the Σ9 and Σ27 coincidence site lattice grain boundaries will occupy random high-angle grain boundary positions, interrupting the random high-angle grain boundary network.

In the present application, by controlling the total deformation of single recrystallization to be not less than 80%, sufficient strain energy is accumulated, high-density dislocations are introduced and the original grain boundary structure is disrupted. Based on the high strain energy structure, large-scale recrystallization and grain boundary migration are driven by annealing treatment at 500-750° C. for 30-150 min, thereby forming low-Σ value coincidence site lattice grain boundaries with a proportion not less than 50%.

Preferably, the recrystallization treatment is a repeated recrystallization process, which is performed for multiple cycles of "block drawing→annealing" after 1-3 passes of block drawing, with a total deformation amount of the 1-3 passes of block drawing before the cycles≤72%; in the multiple cycles of "block drawing→annealing", a number of cycles is 3-6, a deformation amount of block drawing per cycle is 25-35%, an annealing temperature is 500-600° C., and an annealing time is 10-70 min.

In the present application, the repeated recrystallization process has the characteristics of small deformation in a single pass and lower annealing temperature. During lower-temperature annealing, selective recrystallization is preferentially induced at high defect sites, resulting in strain-induced annealing twins. The annealing twin boundaries also migrate and react with random high-angle grain boundaries to form low-Σ value coincidence site lattice grain boundaries without introducing strong crystal orientation, while simultaneously inhibiting excessive grain growth. When the recrystallization structure undergoes deformation again, the low-energy low-Σ value coincidence site lattice grain boundaries are not easily destroyed, while the random high-angle grain boundaries can be continuously activated and migrated through deformation and annealing to form new annealing twins and low-Σ value coincidence site lattice grain boundaries. The superposition and accumulation of low-Σ value coincidence site lattice grain boundaries increase their proportion.

In the present application, by controlling the single-pass deformation in each cycle within the range of 25% to 35%, the controllable strain energy introduction is achieved, prioritizing the destruction of high-energy random high-angle grain boundaries and avoiding the destruction of existing low-energy interfaces. Then, by regulating the annealing temperature and annealing time in each cycle, the strain energy is gradually released, selectively driving the preferential recrystallization of high-strain-energy structures to form low-energy interfaces. Through cyclic processing, a higher proportion of low-Σ value coincidence site lattice grain boundaries can be accumulated, enabling more precise control over these boundaries.

After 3 to 6 cycles of the repeated recrystallization process of the present application, compared with the ordinary process and the single annealing process, the number of low-Σ value coincidence site lattice grain boundaries can be significantly increased, the proportion of the low-Σ value coincidence site lattice grain boundaries is higher than 65%, and the proportion of Σ9, Σ27a and Σ27b is also significantly increased, and (Σ9+Σ27)/Σ3>10.3%, which effectively reduces the connectivity of the random high-angle grain boundary network. However, when the number of cycles exceeds 6, the proportion of the low-Σ value coincidence site lattice grain boundaries will no longer increase significantly as they have reached a saturated state.

Preferably, in the batching and smelting process, the raw materials in accordance with the ratio are first dried and then smelted at 1170-1350° C. Wherein, Ni, Co, B, Zr, P and Sn elements are added in the form of commercially available copper-nickel master alloy, copper-cobalt master alloy, copper-boron master alloy, copper-zirconium master alloy, phosphorus-copper master alloy and copper-tin master alloy, respectively. After the raw materials are completely melted, the temperature is kept for 45-90 min to fully diffuse and homogenize the trace elements. The addition of trace elements in the form of master alloys can promote melting, diffusion and reduce burning loss. Subsequently, the copper liquid is transferred into the casting furnace under nitrogen protection, the temperature of the casting furnace is maintained at 1180-1190° C. for 8-12 min, and then the copper liquid is continuously cast into tube blank.

Preferably, the continuous casting process is horizontal continuous casting, the withdrawal speed is 330-380 mm/min, the primary cooling water flow rate is 30-35 L/min, and the secondary cooling water flow rate is 65-75 L/min. The outer diameter of the horizontal continuous casting tube blank can be designed according to actual needs, for example, 88-98 mm, preferably 92 mm.

Preferably, in the rolling process, the rolling speed is 1.2-2.2 m/min, and a rolled tube blank is obtained after the rolling is completed. The size of the rolled tube blank can be designed according to actual needs, for example, the outer diameter of the rolled tube blank is 50-55 mm, and the wall thickness is 2.3-2.7 mm.

Preferably, the combined drawing process provides a semi-finished product meeting size requirement for subsequent processing processes, the speed of combined drawing is controlled at 70-92 m/min, and a precision tube blank with a significantly reduced outer diameter is obtained after combined drawing. For example, the outer diameter of the rolled tube blank is reduced from 50-55 mm to 30-35 mm, and the wall thickness is thinned from 2.3-2.7 mm to 1.4-1.7 mm by means of combined drawing.

After the combined drawing process, the obtained precision tube blank is subjected to a single recrystallization process or a repeated recrystallization process to prepare a high-performance copper alloy tube with a high proportion of low-Σ value coincidence site lattice grain boundaries. The prepared tubes are not limited by the specification size, including but not limited to bare tubes and internally threaded tubes.

In a single recrystallization process, the passes and specific parameters of the block drawing can be flexibly adjusted according to actual production requirements to ensure that a product meeting target specifications and size requirements is finally obtained. However, it is necessary to ensure that the total deformation of the block drawing is ≥80%, so as to accumulate sufficient strain energy, thereby effectively promoting the formation of a uniformly sized recrystallized structure in the final product during the annealing process, and significantly increasing the proportion of low-Σ value coincidence site lattice grain boundaries. For example, a rolled tube blank with an outer diameter of 30-35 mm and a wall thickness of 1.4-1.7 mm is subjected to 6-9 passes of block drawing to obtain a bare tube with an outer diameter of 5-12 mm and a wall thickness of 0.40-0.65 mm. The total deformation is 81.5% to 96.7%, with the block drawing speed of 450-700 m/min.

In the repeated recrystallization process, the total deformation in the 1-3 passes of block drawing before the cycles is controlled at ≤72%. The specific deformation distribution between passes and detailed process parameters can be flexibly adjusted according to actual production requirements. In the "block drawing→annealing" cycle process, the number of passes and specific process parameters for block drawing within a single cycle can also be flexibly adjusted according to actual production requirements. However, it is essential to ensure that the total deformation of block drawing within a single cycle is 25%-35%, with an annealing temperature of 500-600° C. and an annealing time of 10-70 min per cycle. The number of cycles ranges from 3 to 6, aiming to accumulate a high proportion of low-Σ value coincidence site lattice grain boundaries and increase the (Σ9+Σ27)/Σ3 ratio. For example, a rolled tube blank with an outer diameter of 30-35 mm and a wall thickness of 1.4-1.7 mm is subjected to 1-2 passes of block drawing process to obtain an intermediate tube blank with an outer diameter of 20-26 mm and a wall thickness of 0.85-1.2 mm. This intermediate tube blank then undergoes the "block drawing-annealing" cycle process to produce bare tubes with an outer diameter of 5-12 mm and a wall thickness of 0.40-0.65 mm, at a block drawing speed of 450-700 m/min.

When producing internally threaded tubes via the single recrystallization process route, an on-line annealing step is required after the block drawing process to soften the tube blank. The preferred parameters for the on-line annealing process are: speed 300-450 m/min, current 3600-5000 A. The tube blank obtained from on-line annealing is subsequently subjected to internal thread spinning molding. The preferred spinning speed is 480-650 r/m, and more preferably 550-600 r/m. Then, the finished product is annealed to obtain an internally threaded tube, preferably at an annealing temperature of 510-650° C. for 30-120 min.

When producing internally threaded tubes via the repeated recrystallization process route, the last pass of "block drawing→annealing" cycle process is replaced by the "internal thread forming→internally threaded tube annealing" process. The preferred spinning speed for internal thread forming is 480-650 r/m, and more preferably 550-600 r/m. Preferably, the internally threaded tube is annealed at 500-580° C. for 10-70 min.

It should be noted that the copper alloy composition provided by the present application is not only suitable for tube production, but also can be used for the preparation of various copper alloy products such as wires, rods, plates and strips. The production process can not only adopt existing mature processing technologies, such as extrusion, rolling, drawing and forging, but also optimize and adjust process parameters or develop new processing methods according to specific product performance requirements and application scenarios, so as to meet the diversified requirements of different industries for copper alloy materials. The high-performance copper alloy tube is not only suitable for the field of heat exchange, but also plays an important role in the fields of marine engineering, energy chemical industry and the like, especially excels in scenarios with complex environments and high use requirements for material performance.

Compared with the related art, the present application has at least the following technical effects:

(1) The present application, by adding Sn, Ni and P elements to Cu in combination, adjusting the content and ratio of each element, and combining with subsequent recrystallization treatment process, enables the copper alloy to have enhanced strength while processing a high proportion of low-Σ value coincidence site lattice grain boundaries, effectively reducing the yield-to-tensile ratio and preserving high formability. The copper alloy demonstrates excellent performance in application processes such as bending, flaring, and tube expansion, along with superior pressure resistance, corrosion resistance, and high-temperature softening resistance.

(2) In the present application, Zr, Co, and B (optionally) elements are added on the basis of Cu, Sn, Ni, and P elements, and by controlling the content and ratio of each element in combination with the subsequent improved recrystallization treatment process, the strength, plastic deformation ability, pressure resistance, corrosion resistance, and high-temperature softening resistance of the alloy are further improved compared with copper alloys prepared from Cu, Sn, Ni, and P elements.

(3) The recrystallization treatment process of the present application includes single recrystallization and repeated recrystallization, which can be realized by using existing production lines and has strong adaptability to existing equipment. According to the present application, a copper alloy with excellent performance can be obtained by combining designed alloy components with a single recrystallization process. In combination with the repeated recrystallization process, the proportion of the low-Σ value coincidence site lattice grain boundaries and the ratio of (Σ9+Σ27)/Σ3 can be significantly improved, and the strength, plastic deformation ability, pressure resistance, corrosion resistance and high-temperature softening resistance of the alloy are further improved compared with the copper alloy prepared by a single recrystallization process.

BRIEF DESCRIPTION OF DRAWINGS

FIG. 3(*b*) is the grain boundary distribution diagram of Comparative Example 1; FIG. 3(*c*) is the IPF of Example 2; FIG. 3(*d*) is the grain boundary distribution diagram of Example 2; FIG. 3(*e*) is the IPF of Example 5 after three cycles of repeated recrystallization; FIG. 3(*f*) is the grain boundary distribution diagram of Example 5 after three cycles of repeated recrystallization; FIG. 3(*g*) is the IPF of Example 5 after four cycles of repeated recrystallization; and FIG. 3(*h*) is the grain boundary distribution diagram of Example 5 after four cycles of repeated recrystallization.

FIG. 5 (*b*) is the cross-sectional morphology of the bent tube specimen after the ant-nest corrosion test of Comparative Example 1; FIG. 5 (*c*) is the cross-sectional morphology of the specimen after the ant-nest corrosion test of Example 2; and FIG. 5 (*d*) is the cross-sectional morphology of the bent tube specimen after the ant-nest corrosion test of Example 2.

FIG. 6 (*b*) is the fracture image of the welded tube specimen after the hydraulic burst test for Comparative Example 1; FIG. 6 (*c*) is the fracture image of the specimen after the hydraulic burst test for Example 2; and FIG. 6 (*d*) is the fracture image of the welded tube specimen after the hydraulic burst test for Example 2.

FIG. 7 (*b*) is the KAM diagram measured after 5% tensile deformation in Example 2.

DETAILED DESCRIPTION OF THE INVENTION

Best Mode

Figure 1:
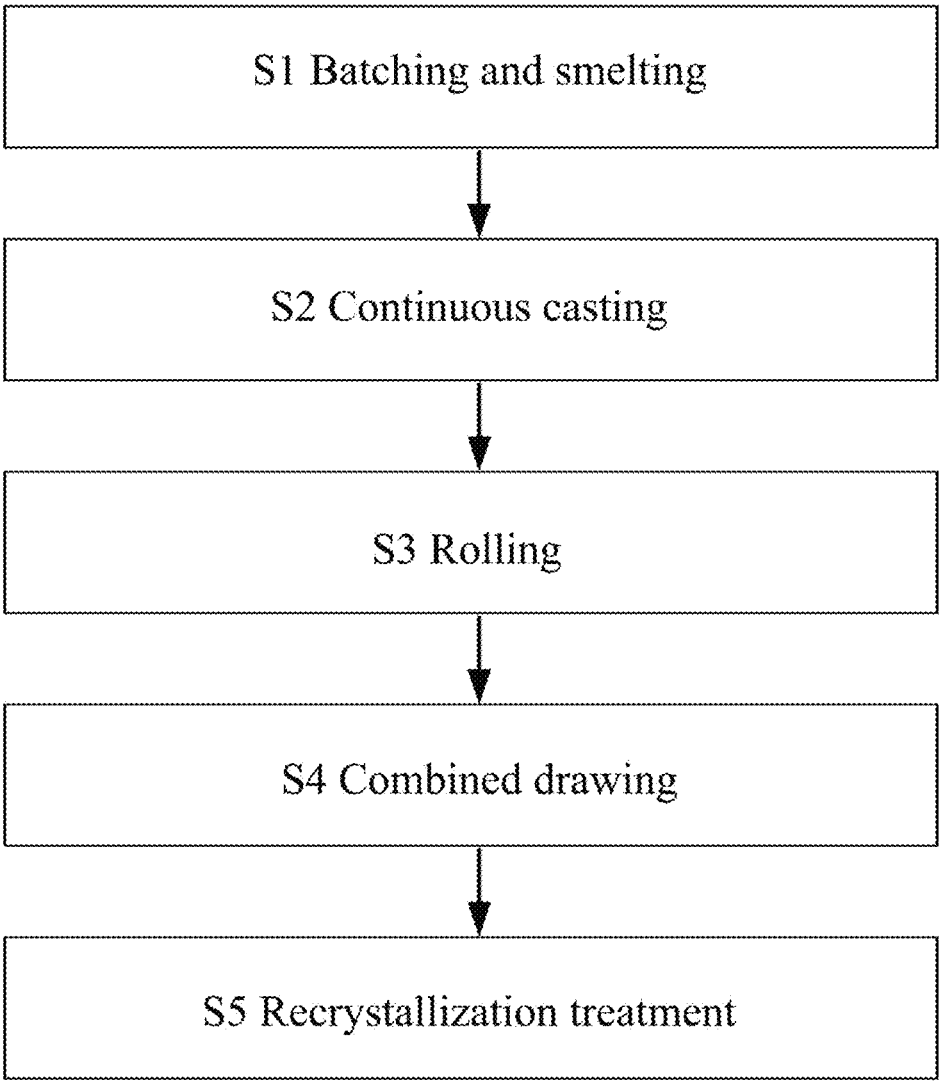
FIG. 1 is a process route diagram of the present application.

The technical solutions and advantages of the present application will be described more clearly and completely below in conjunction with the drawings and specific examples in the embodiments of the present application. It is obvious that the described examples are part of the examples of the present application, but not all the examples. All other examples obtained by a person of ordinary skill in the art based on the examples of present application without creative efforts shall fall within the protection scope of present application.

If specific conditions are not indicated in the examples, they are carried out according to conventional conditions or conditions recommended by the manufacturer. The raw materials and reagents used are conventional products commercially available.

The performance parameters involved in the examples of the present application are measured by the following methods.

The average grain size of the metallographic structure was tested according to GB/T 6394-2017 Determination of estimating the average grain size of metal.

The mechanical properties at room temperature such as yield strength, ultimate tensile strength, elongation after fracture were tested on an electronic universal mechanical property testing machine according to GB/T 228.1-2010 Metallic materials-Tensile testing-Part 1: Method of test at room temperature, using an extensometer with a gauge length of 50 mm, a tensile speed of 5 mm/min, and three parallel specimens.

The pressure resistance was tested according to GB/T 241-2007 Metal materials-Tube-Hydrostatic pressure test, to obtain the burst pressure of the copper alloy tube; the copper tube was welded and then subjected to the same pressure resistance test to obtain the burst pressure after tube welding. The burst pressure decay rate after tube welding is defined as:

the burst pressure decay rate after tube welding =

(burst pressure − burst pressure after tube welding)/burst pressure * 100%.

The bending test in the process performance was tested according to GB/T 244-2008 Metallic materials-Tube-Bend test. When bent 180° under the condition that the Mandrel Diameter is 1.5 times the outer diameter of the copper tube, the inner and outer surfaces remained smooth, free from wrinkles or cracks. The flaring test was tested according to GB/T 17791-1999 Specification for seamless copper tube for air conditioning and refrigeration field service. For the flaring test, using a 60° taper punch and achieving a 40% flaring rate, or when the distance between the two walls after flattening equals the wall thickness, the specimen exhibits no visible cracks or fractures to the naked eye, indicating excellent process performance.

For ant-nest corrosion test, 13 parallel specimens were taken from each copper alloy, with each specimen being 10 cm in length. The copper tube specimens were first pretreated by being ultrasonically cleaned sequentially in anhydrous ethanol, acetone, and deionized water for 3 minutes each to remove surface oils and contaminants. The copper tube specimens were then sealed at both ends, with only the outer surface exposed to the formic acid atmosphere. The pretreated copper tubes were suspended in a sealed chamber containing a 0.4% formic acid aqueous solution. The ratio of solution volume to specimen surface area was no less than 5 $cm^3/cm^2$. The chamber was heated in a water bath to 40° C. maintaining for 48 hours, followed by being placed at room temperature for 48 hours, and then repeated hot and cold alternating for 21 days. After the corrosion test, seven equidistant cross-sections were selected from each specimen for corrosion depth test. The seven data with the largest corrosion depth of each specimen were recorded and averaged to represent the maximum corrosion depth of the specimen. The average of these maximum corrosion depths across the 13 parallel specimens was then calculated as the single-tube maximum corrosion depth of the copper alloy under the specified test conditions.

For the bent tube corrosion test, specimens were prepared according to bending test requirements, with each specimen having a length of 15 cm and the bent tube center located in the axial center of the specimen. Following the ant-nest corrosion test procedure described above, the specimens were pretreated and sealed at both ends. The outer part of the bent portion of the specimen was suspended downward in a sealed chamber containing formic acid aqueous solution for corrosion testing. After testing, seven cross-sections were sampled from each specimen: starting from the bent tube center, three cross-sections were taken at 5 mm intervals toward both sides, including the bent tube center cross-section. Corrosion depth tests were performed on these sections. All other test and data processing requirements remained consistent with the ant-nest corrosion test, thereby determining the maximum corrosion depth at a bent portion.

The corrosion resistance decay rate at a bent portion is defined as:

Corrision resistance decay rate at a bent portion =

(maximum corrosion depth at a bent portion − single−tube maximum corrosion depth)/single−tube maximum corrosion depth * 100%.

The XRD pattern test was conducted using a Rigaku Smartlab X-ray diffractometer with a continuous scanning speed of 1°/min, a 2θ range of 35°~100°, and a copper target.

The EBSD test was conducted using a German Carl Zeiss Sigma 300 field emission scanning electron microscope equipped with an Oxford Symmetry S2 EBSD probe, with a scanning step of 0.5 microns. Data analysis was conducted using the AZtec Crystal 2.1 software. The classification of coincidence site lattice grain boundaries was determined according to the Brandon criterion. Specifically, grain boundaries with a misorientation of 60°/<111>, an angular deviation ≤8.7°, and an axis deviation ≤8.2° were defined as Σ3 coincidence site lattice grain boundaries. Grain boundaries with a misorientation of 38.9°/<110>, an angular deviation ≤5.0°, and an axis deviation ≤2.7° were defined as Σ9 coincidence site lattice grain boundaries. Grain boundaries with misorientations of 31.6°/<110> and 35.4°/<210>, angular deviations ≤2.9°, and axis deviations ≤0.9° were defined as Σ27a and Σ27b coincidence site lattice grain boundaries, respectively.

Examples 1-4

Examples 1~4 provided a bare tube of copper alloy material containing Sn, Ni and P and a preparation method using a single recrystallization process route, wherein the specific preparation method of Example 1 included the following steps:

S1. Batching and Smelting

Raw materials of electrolytic copper (purity ≥99.98%), copper-nickel master alloy (Cu-42% Ni), phosphorus-copper master alloy (Cu-14% P) and copper-tin master alloy (Cu-50% Sn) were prepared according to the designed chemical composition of the copper alloy and dried for later use. The feeding in the form of the master alloy was beneficial to reducing the melting temperature of high-melting-point elements, accelerating melting, and reducing element burning loss and oxidation.

After the electrolytic copper plates were smelted, the temperature of the copper liquid was adjusted to 1200° C., the copper-nickel master alloy, the phosphorus-copper master alloy and the copper-tin master alloy were added in proportion, the copper liquid was stirred with a graphite rod, the surface of the copper liquid was covered with charcoal to prevent oxidation of the copper liquid and reduce the burning loss. The mixture was held at temperature for 60 min to fully diffuse the elements, promote the homogenization of the copper liquid elements, and allow time for the float and escape of gases and non-metallic inclusions, thereby facilitating deoxidation and degassing. The copper liquid was transferred into the casting furnace for casting preparation, nitrogen gas was used for protection in the transfer process to physically isolate the air, reducing the risk of oxidation and impurity absorption in the copper liquid transfer process. Graphite flakes were covered on the surface of the copper liquid in the casting furnace to prevent oxidation of the copper liquid, the copper liquid in the casting furnace was maintained at 1185° C. for 10 min.

S2. Continuous Casting

The copper liquid in the casting furnace was continuously cast into a tube blank horizontally, with a withdrawal speed of 350 mm/min, a primary cooling water flow rate of 35 L/min, and a secondary cooling water flow rate of 69 L/min. The tube blank had an outer diameter of 92 mm, an inner diameter of 38.5 mm, and a fixed length of 8 m. Subsequently, the tube blank was subjected to a scalping treatment to a depth of 1 mm, removing surface oxide scale and preventing surface defects from entering into the material accompanying subsequent rolling processes.

S3. Rolling

The continuously cast tube blank underwent diameter reduction via a three-roll planetary rolling process. During rolling, the tube blank generated heat through friction to facilitate deformation. The rolling speed was 1.4 m/min, the outer diameter was reduced to 51 mm, and the wall thickness was reduced to 2.4 mm.

S4. Combined Drawing

The rolled intermediate tube blank underwent diameter reduction through a combined drawing process at a speed of 72 m/min, reducing the outer diameter to 31 mm and the wall thickness to 1.4 mm.

S5. Single Recrystallization Process

The intermediate tube blank from combined drawing underwent a 7-pass block drawing process. The block drawing speed was 450 m/min for the first pass, 660 m/min for 2nd to 6th passes, and 620 m/min for the 7th pass, producing a bare tube with an outer diameter of 9.52 mm and a wall thickness of 0.55 mm. The total deformation during block drawing was 88.1%. The tube blank was then subjected to final annealing in a vacuum atmosphere at a temperature of 580° C. for 90 min, yielding the copper alloy tube of Example 1. Its specific chemical composition was shown in Table 1.

The preparation method of Example 2 was the same as that of Example 1, except that in step S1, the chemical composition and raw material ratio of the copper alloy were different, and the specific chemical composition was shown in Table 1.

Example 3 differed from Example 1 in that:

In the step S1, the chemical composition and raw material ratio of the copper alloy were different, and the specific chemical composition was shown in Table 1.

In the step S5, the annealing temperature was 600° C., the annealing time was 90 min. The purpose of changing the annealing temperature was to make the complete recrystallization degree of each Example consistent after the chemical composition changed, that was, the average grain size excluding twin boundaries was similar.

Example 4

Example 4 differed from Example 1 in that:

In the step S1, the chemical composition and raw material ratio of the copper alloy were different, and the specific chemical composition was shown in Table 1.

In the step S5, the annealing temperature was 600° C., and the annealing time was 90 min.

Examples 5-6

Examples 5-6 provided a bare tube of copper alloy material containing Sn, Ni, and P, and a preparation method thereof using a repeated recrystallization process route.

Example 5 differed from Example 1 in that:

In the step S1, the chemical composition and raw material ratio of the copper alloy were different, and the specific chemical composition was shown in Table 1.

The step S5 was a repeated recrystallization process, and the specific process was as follows:

The intermediate tube blank from combined drawing was subjected to 2-pass block drawing process. The block drawing speed was 450 m/min for the first pass and 660 m/min for the second pass, reducing the outer diameter to 21 mm and the wall thickness to 0.98 mm, with a total block drawing deformation of 52.7%. A "block drawing-annealing" cyclic process was then implemented. In the first cycle, the block drawing deformation was 30.3% at a block drawing speed of 600 m/min, followed by annealing at 530° C. for 20 min. In the second cycle, the block drawing deformation was 29.4% at a block drawing speed of 600 m/min, followed by annealing at 530° C. for 20 min. In the third cycle, the block drawing deformation was 29.2% at a block drawing speed of 600 m/min, followed by annealing at 530° C. for 20 min. In the fourth cycle, the block drawing deformation was 27.9% at a block drawing speed of 600 m/min, followed by annealing at 530° C. for 20 min. The copper alloy tube of Example 5 was thus obtained, and its specific chemical composition was shown in Table 1.

Example 6 differed from Example 5 in that:

In the step S1, the chemical composition and raw material ratio of the copper alloy were different, and the specific chemical composition was shown in Table 1.

In the step S5, the annealing temperature was 540° C.

Examples 7-10

Examples 7-10 provided a bare tube of copper alloy containing Sn, Ni, P, Zr, and Co and a preparation method thereof using a single recrystallization process route.

Examples 7 and 9 differed from Example 1 in that:

In the step S1, the chemical composition and raw material ratio of the copper alloy were different. In addition to adding the copper-nickel master alloy, the phosphorus-copper master alloy and the copper-tin master alloy according to the designed ratio, it was also necessary to incorporate a copper-cobalt master alloy (Cu-10% Co) and a copper-zirconium master alloy (Cu-10% Zr). The specific chemical composition was shown in Table 1.

Examples 8 and 10 differed from Example 7 in that:

In the step S1, the chemical composition and raw material ratio of the copper alloy were different, and the specific chemical composition was shown in Table 1.

In the step S5, the annealing temperature was 620° C.

Example 11

Example 11 provided a bare tube of copper alloy containing Sn, Ni, P, Zr, Co, and B and a preparation method thereof using a single recrystallization process route.

Example 11 differed from Example 7 in that:

In the step S1, the chemical composition and raw material ratio of the copper alloy were different. In addition to adding the copper-nickel master alloy, the copper-cobalt master alloy, the copper-zirconium master alloy, the phosphorus-copper master alloy and the copper-tin master alloy according to the designed ratio, it was also necessary to incorporate a copper-boron master alloy (Cu-5% B). The specific chemical composition was shown in Table 1.

Examples 12-15

Examples 12-15 provided a bare tube of copper alloy containing Sn, Ni, P, Zr, Co, and optionally B, and a preparation method thereof using a repeated recrystallization process route.

The chemical composition of Example 12 was the same as that of Example 7 (the same batch of cast blanks), except that the step S5 was a repeated recrystallization process.

The repeated recrystallization process used in Example 12 was the same as that used in Example 5.

Example 13 differed from Example 12 in that:

In the step S1, the chemical composition and raw material ratio of the copper alloy were different, and the specific chemical composition was shown in Table 1.

In the repeated recrystallization process of step S5, the annealing temperatures in all the "block drawing-annealing" cycles were maintained at 540° C. with the annealing time of 20 min, so that the alloy was completely recrystallized.

Examples 14 and 15 differed from Example 13 in that, in step S1, the chemical composition and raw material ratio of the copper alloy were different, and the specific chemical composition was shown in Table 1.

Example 16

Example 16 provided an internally threaded tube of copper alloy containing Sn, Ni, P, Zr, Co, and B and a preparation method thereof using a repeated recrystallization process route.

Example 16 had the same chemical composition as Example 15 (from the same batch of cast blanks), except that:

In the step S5, the fourth cycle was replaced by the "internal thread forming→internally threaded tube annealing" process; the tube blank after the third cycle was subjected to spinning forming at a spinning speed of 550 r/m to prepare an internally threaded tube of 7 mm*0.23 mm+0.1 mm (outer diameter*bottom wall thickness+tooth height), and then was annealed at an annealing temperature of 570° C. for 30 min.

Comparative Example 1

This comparative example provided an existing copper tube specimen from Zhejiang Hailiang Co., Ltd., which was a TP2 bare tube with a specification of 9.52 mm*0.55 mm (outer diameter*wall thickness) and specific composition shown in Table 2.

Comparative Example 2

This comparative example provided an existing copper tube specimen from Zhejiang Hailiang Co., Ltd., which was a TP2 internally threaded tube with a specification of 7 mm*0.23 mm+0.1 mm and specific composition shown in Table 2.

Comparative Example 3

This comparative example provided a Cu—Sn—Ni—P copper alloy material with a high Sn content and a high f2 value, along with the specific steps for its preparation using a single recrystallization process route.

This comparative example differed from Example 1 in that:

In the step S1, the chemical composition and raw material ratio of the copper alloy were different, and the specific chemical composition was shown in Table 2.

In the step S5, the annealing temperature was 620° C., and the annealing time was 90 min.

Comparative Example 4

This comparative example provided a Cu—Sn—Ni—P copper alloy bare tube with low f1 and f2 values, along with the specific steps for its preparation using a single recrystallization process route.

This comparative example differed from Example 1 in that:

In the step S1, the chemical composition and raw material ratio of the copper alloy were different, and the specific chemical composition was shown in Table 2.

In the step S5, the annealing temperature was 620° C., and the annealing time was 90 min.

Comparative Example 5

This comparative example provided a Cu—Sn—Ni—P copper alloy bare tube with a high Ni content and a low f2 value, along with the specific steps for its preparation using a single recrystallization process route.

This comparative example differed from Example 1 in that:

In the step S1, the chemical composition and raw material ratio of the copper alloy were different, and the specific chemical composition was shown in Table 2, with the smelting temperature increased to 1250° C.

In the step S5, the block drawing speed for the 2nd to 6th passes was 600 m/min, and for the 7th pass it was 550 m/min, the final annealing temperature was 650° C., and the annealing time was 90 min.

Comparative Example 6

This comparative example provided a Cu—Sn—Ni—P copper alloy bare tube with a high Sn content and high f1 and f2 values, along with the specific steps for its preparation using a single recrystallization process route.

This comparative example differed from Example 1 in that:

In the step S1, the chemical composition and raw material ratio of the copper alloy were different, and the specific chemical composition was shown in Table 2, with the smelting temperature increased to 1250° C.

In the step S5, the block drawing speed for the 2nd to 6th passes was 600 m/min, and for the 7th pass it was 550 m/min, the final annealing temperature was 650° C., and the annealing time was 90 min.

Comparative Example 7

This comparative example provided a Cu—Sn—Ni—P—Zr—Co copper alloy bare tube with high Co and Zr contents, along with the specific steps for its preparation using a single recrystallization process route.

This comparative example differed from Example 7 in that:

In the step S1, the chemical composition and raw material ratio of the copper alloy were different, and the specific chemical composition was shown in Table 2.

In the step S5, the block drawing speed for the 2nd to 6th passes was 600 m/min, and for the 7th pass it was 550 m/min, the final annealing temperature was 650° C., and the annealing time was 90 min.

Comparative Example 8

This comparative example provided a Cu—Sn—Ni—P—Zr—Co—B copper alloy bare tube with high Zr, Co and B contents, along with the specific steps for its preparation using a single recrystallization process route.

This comparative example differed from Example 11 in that:

In the step S1, the chemical composition and raw material ratio of the copper alloy were different, and the specific chemical composition was shown in Table 2, with the smelting temperature increased to 1250° C.

In the step S5, the block drawing speed for the 2nd to 6th passes was 600 m/min, and for the 7th pass it was 550 m/min, the final annealing temperature was 650° C., and the annealing time was 90 min.

The chemical composition and f1 and f2 values of the copper alloys in the examples and comparative examples of the present application were shown in Table 1 and Table 2. The proportion of the low-Σ value coincidence site lattice grain boundaries and average grain size of the copper alloys in the examples and comparative examples of the present application were shown in Table 3. The proportion detailed table of low-Σ value coincidence site lattice grain boundaries in the copper alloys from the examples and comparative examples of the present application, as well as the effect of the number of cycles in the repeated recrystallization process on the proportion of coincidence site lattice grain boundaries, were shown in Table 4. The mechanical properties, burst pressure, and formability of the copper alloys from the examples and comparative examples of the present application were shown in Table 5. The ant-nest corrosion resistance of the copper alloys from the examples and comparative examples of the present application were shown in Table 6.

Figure 2:
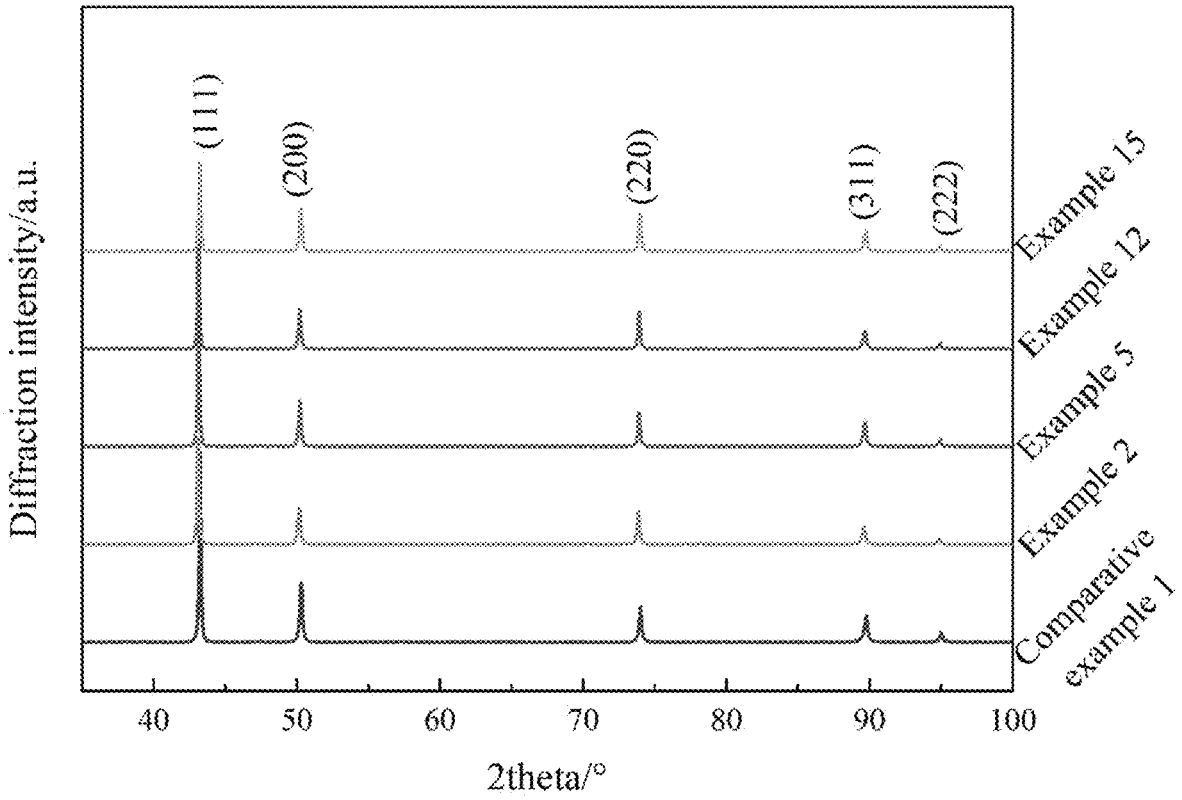
FIG. 2 shows X-ray diffraction (XRD) spectra of Example 2, Example 5, Example 12, Example 15 and Comparative Example 1 of the present application.

Examples 1-3 and Comparative Example 1 demonstrate that with essentially constant Ni and P contents, as the Sn content increases, both the f1 and f2 values rise. The proportions of Σ3, Σ9, and Σ27 coincidence site lattice grain boundaries increase to 57.36%, 61.12%, and 62.97%, respectively (see Table 3 and FIGS. 3(*a*), 3(*b*), 3(*c*), 3(*d*)). Furthermore, XRD testing results indicate that the alloys possess a single α phase (see FIG. 2). At the same time, it can be seen from Examples 1-3 that the yield strength and tensile strength of the copper alloy increase synchronously with the increase of the Sn content (see Table 5), which proves that the Sn element has a significant solid solution strengthening effect and can synchronously improve the yield strength and tensile strength. Compared with Comparative Example 1, the tensile strengths of Examples 1, 2, 3 are improved by 12.1%, 17.7%, and 21.1%, respectively, but the yield strength of Example 1 does not exceed that of Comparative Example 1, indicating that the high proportions of Σ3, Σ9, and Σ27 coincidence site lattice grain boundaries are conducive to providing a high proportion of low-energy, coherence low-Σ value coincidence site lattice grain boundaries. These grain boundaries impose less restriction on dislocation motion during the early stages of plastic deformation compared to random high-angle grain boundaries. Consequently, by reducing the hindrance of interfaces to dislocation motion in the initial deformation stage, it is possible to maintain a relatively low yield strength to some extent, thereby lowering the yield-to-tensile ratio within 0.30.

Figure 6:
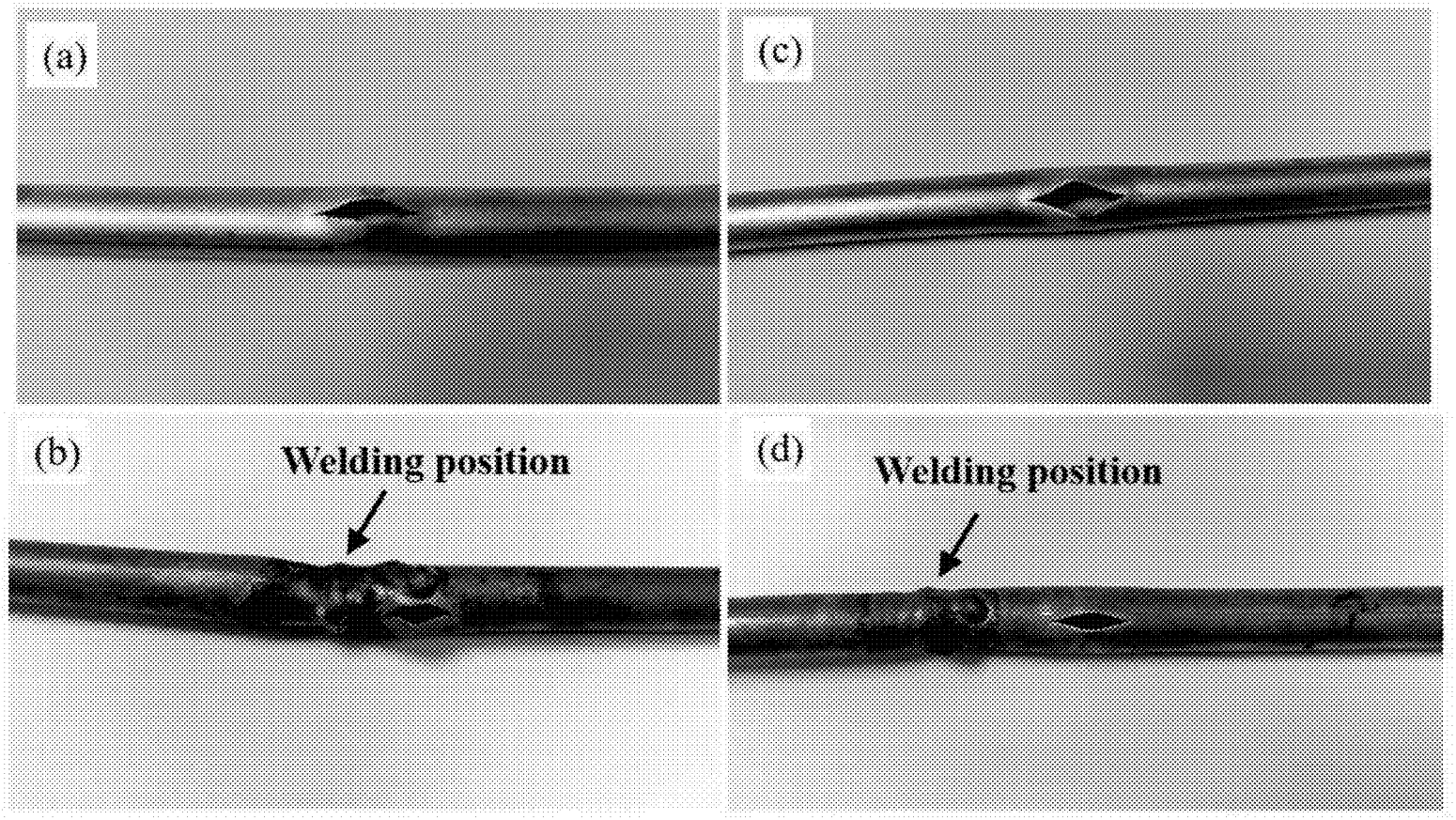
FIG. 6 shows the fracture images of the specimens after the hydraulic burst test for Example 2 and Comparative Example 1 of the present application, as well as the fracture images of the welded tube specimens after the hydraulic burst test, wherein FIG. 6 (*a*) is the fracture image of the specimen after the hydraulic burst test for Comparative Example 1.

It can be seen from Table 5 that the burst pressure of the copper alloy tubes of the same specification increases with the increase of Sn content, and the burst pressures of Examples 1, 2, 3 are increased by 7.3%, 14.2% and 20.7% compared with Comparative Example 1, respectively. The burst pressure decay rate after tube welding of Examples 1, 2, 3 are all lower than 10.0%, which is because the introduction of the high proportion of the low-Σ value coincidence site lattice grain boundary inhibits the grain boundary migration and abnormal grain growth at high temperature to a certain extent, thereby reducing the burst pressure decay rate after tube welding. The fracture position and morphology of the specimen after hydraulic burst test and the welded tube specimen after hydraulic burst test for Example 2 are shown in FIG. 6.

It can be seen from Table 6 that under the same formic acid atmosphere corrosion conditions, the maximum corrosion depths of Examples 1, 2, 3 are gradually reduced compared with Comparative Example 1, and the corrosion resistance improvement ratios are 15.8%, 17.9% and 21.5%, respectively. Compared with Comparative Example 1, Examples 1-3 have a certain Ni content, which helps to improve corrosion resistance. Although the Ni content in Examples 1-3 is similar, Example 3 possesses a higher total proportion of Σ3, Σ9, and Σ27 boundaries. These low-Σ value coincidence site lattice grain boundaries exhibit better coherency, lower energy, and minimal impurity element segregation, making them resistant pathways for corrosion propagation, without the promoting effect of random high angle grain boundaries on the corrosion process. Moreover, the increased (Σ9+Σ27)/Σ3 ratio (see data in Table 4 for Examples 1-3 and Comparative Example 1) disrupts the original network of random high-angle grain boundaries and interrupts the original paths for intergranular corrosion, thereby slowing down the ant-nest corrosion process to a certain extent.

Figure 7:
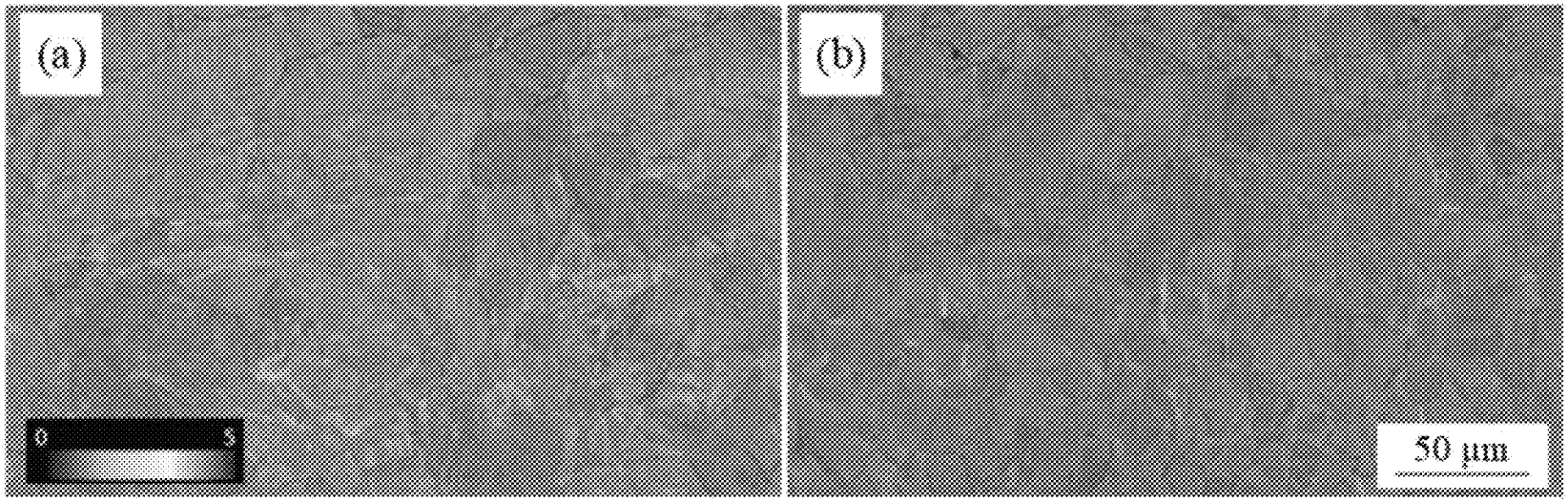
FIG. 7 shows the Kernel average misorientation diagram (KAM diagram) measured after 5% tensile deformation in Example 2 and Comparative Example 1 of the present application, wherein FIG. 7 (*a*) is the KAM diagram measured after 5% tensile deformation in Comparative Example 1.

The corrosion resistance of Examples 1, 2, 3 after tube bending is also improved compared with that of Comparative Example 1, and the corrosion resistance decay rate at a bent portion is all lower than 17.0%, indicating that a high total proportion of Σ3, Σ9, and Σ27 boundaries also exhibits a certain inhibitory effect against the synergistic promotion of ant-nest corrosion by the combined action of stress corrosion and intergranular corrosion. As shown in FIG. 7, compared with Comparative Example 1, Example 2 exhibits more uniform strain distribution and a lower average KAM value after 5% tensile deformation, indicating a significantly reduced strain concentration level relative to TP2 copper. This demonstrates that finer grain size (including twin boundaries) and a high proportion of low-Σ value coincidence site lattice grain boundaries facilitate homogeneous strain distribution, thereby mitigating the stress and intergranular corrosion effect.

Compared with Example 2, Example 4 increases the Ni content and reduces the f2 value, resulting in a decrease in the total amount of Σ3, Σ 9 and Σ27 to 57.42%. However, due to the higher Ni content, it demonstrates superior resistance to ant-nest corrosion, showing an 8.8% improvement relative to Example 2. However, due to the lower total amount of Σ3, Σ9 and Σ27, the corrosion resistance decay rate at a bent portion is increased compared with Example 2.

Examples 2, 3 demonstrate that by controlling the values of f1 and f2 in the preferred range of 0.65%≤f1≤1.05% and 3.4≤f2≤5, the tensile strength of the copper alloy can be further improved to 275 MPa or more, and the low yield-to-tensile ratio can be maintained, so that the copper alloy can not only meet the requirements of bending, expanding, and flaring processes, but also further improve the pressure resistance, corrosion resistance and heat softening resistance. Compared with Comparative Example 1, the burst pressure and the corrosion resistance of the single tube of Example 1 are only improved by 7.3% and 15.8%, respectively, while Example 3 is improved by 20.7% and 21.5%, respectively, indicating that the pressure resistance and corrosion resistance of the copper alloy tube prepared after optimization are both greatly improved. Meanwhile, compared with Example 1, Example 3 also has a reduced burst pressure decay rate and corrosion resistance decay rate.

Comparative Example 3 shows that when the concentration of Sn atoms reaches the limit of solid solution solute atoms with a dilute concentration, the distance between solute atoms will become smaller, so that the hindrance ability of solute atoms to dislocation motion is greatly increased. Consequently, the beneficial effect of reducing the yield-to-tensile ratio brought by the low-Σ value coincidence site lattice grain boundaries in Comparative Example 3 is almost offset by the hardening effect brought by solute atoms, which is shown that the bending test is good but the flaring test is unqualified.

Comparative Example 4 demonstrates that when the values of f1 and f2 are too low, the total amount of Σ3, Σ9 and Σ27 cannot reach 50% or more, making it difficult to maintain good formability. Therefore, although Comparative Example 4 shows increased strength and passes the bending test, it exhibits poor flaring performance.

Comparative Example 5 demonstrates that even with an appropriate f1 value, copper alloys with high Ni content exhibit significantly deteriorated elongation after fracture, a yield-to-tensile ratio as high as 0.40, extremely poor flaring performance, and failing to meet bending performance requirements.

Comparative Example 6 demonstrates that the high Sn content can induce pronounced hardening effect, which makes Comparative Example 6 have a yield-to-tensile ratio as high as 0.39 and extremely poor flaring performance, while also failing to meet the bending performance requirements.

A comparison between Examples 5, 6 and Examples 2, 3 demonstrates that when the repeated recrystallization process is applied to copper alloys with similar chemical composition, the total proportion of Σ3, Σ9, and Σ27 boundaries can be effectively accumulated through cycling, increasing from approximately 60% to 72-75% (see Table 3), while the average grain size (including twin boundaries) is slightly reduced. Taking Example 2 and Example 5 as an example, the ratio of (Σ9+Σ27)/Σ3 is increased from 4.3% to 12.5% (see Table 4), which is manifested in a significant improvement in tensile strength and pressure resistance along with a reduced yield-to-tensile ratio for Example 5, while maintaining similar yield strength to Example 2. In Example 5, the burst pressure decay rate after tube welding is only 3.2%, and the corrosion resistance decay rate at a bent portion is only 6.2%, indicating that the high proportion of Σ3, Σ9, and Σ27 coincidence site lattice grain boundaries and the high ratio of (Σ9+Σ27)/Σ3 are advantageous for improving the high-temperature softening resistance of the copper alloy and reducing the corrosion promoted by grain boundaries and stress.

From the comparison between Examples 7, 9 and Example 2, and the comparison between Examples 8, 10 and Example 3, it can be seen that on the basis of the composite addition of Sn, Ni, and P, the trace addition of Zr element can further improve the f1 value of the alloy, increase the proportions of Σ3, Σ9, and Σ27 coincidence site lattice grain boundaries, further improve the tensile strength and burst pressure and maintain a low yield-to-tensile ratio of about 0.22-0.29, and the trace addition of Co element can generally reduce the decay rate after welding the tube to within 6%. From the comparison between Example 10 and Example 8, it can be seen that the content of Zr and Co is further improved, and the pressure resistance, corrosion resistance and high-temperature softening resistance of the alloy are all further improved, especially, with the addition of Co and Zr elements, the burst pressure decay rate of the alloy is greatly reduced.

Comparative Example 7 demonstrates that when the Sn and Ni contents are appropriate, excessive addition of Zr and Co can reduce the elongation after fracture and increase the yield-to-tensile ratio due to the introduction of hard and brittle second phases, while simultaneously deteriorating both bending and flaring performance.

The comparison between Example 11 and Example 7 demonstrates that a trace addition of B element can effectively reduce the oxygen content of the alloy to 15 ppm or less, and can significantly refine the size of the cast dendritic structure. Compared with Example 7, the improvement in the ant-nest corrosion resistance performance of Example 11 relative to the TP2 alloy is increased from 18.7% to 23.5%.

Comparative Example 8 demonstrates that the addition amounts of Zr, Co and B elements cannot be too high, otherwise the formed hard and brittle phase inclusions can greatly improve the yield strength and yield-to-tensile ratio and reduce the ductility, thereby reducing the formability and severely deteriorating both bending and flaring performance.

Figure 4:
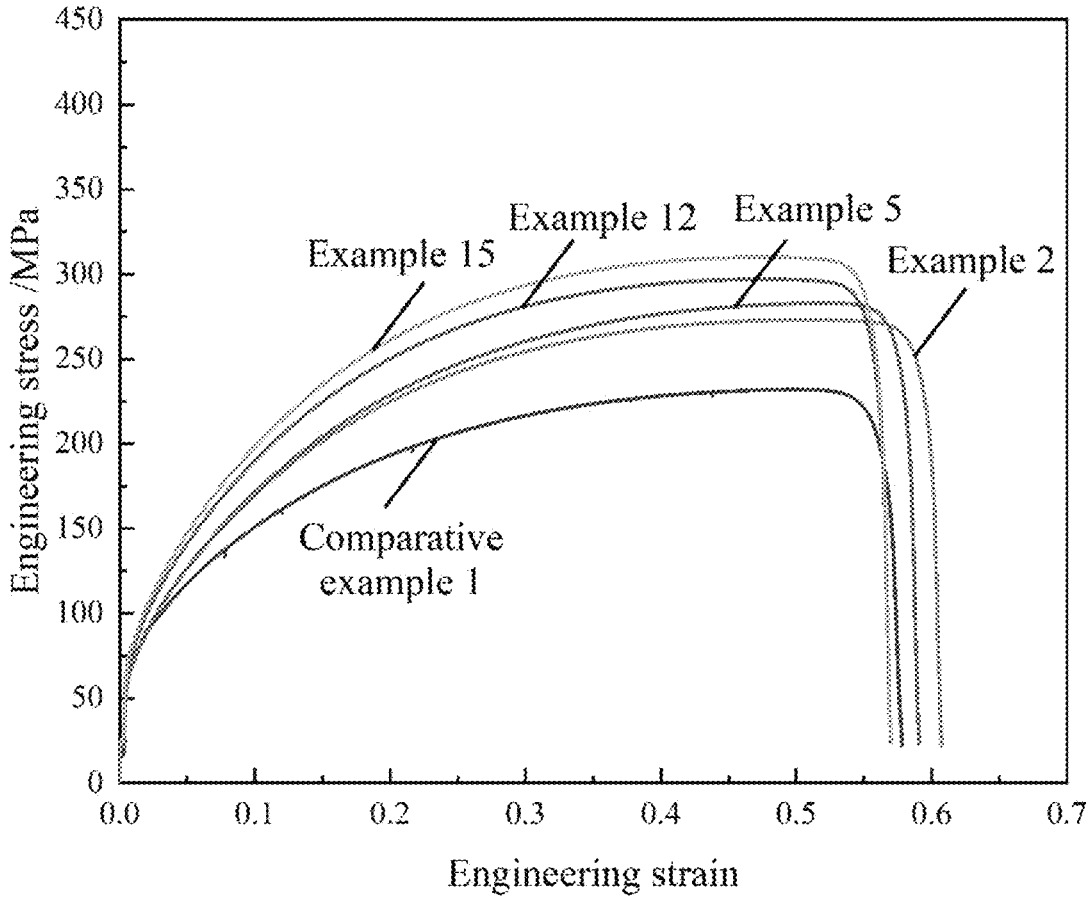
FIG. 4 shows engineering stress-strain curves of Example 2, Example 5, Example 12, Example 15 and Comparative Example 1 of the present application.
Figure 5:
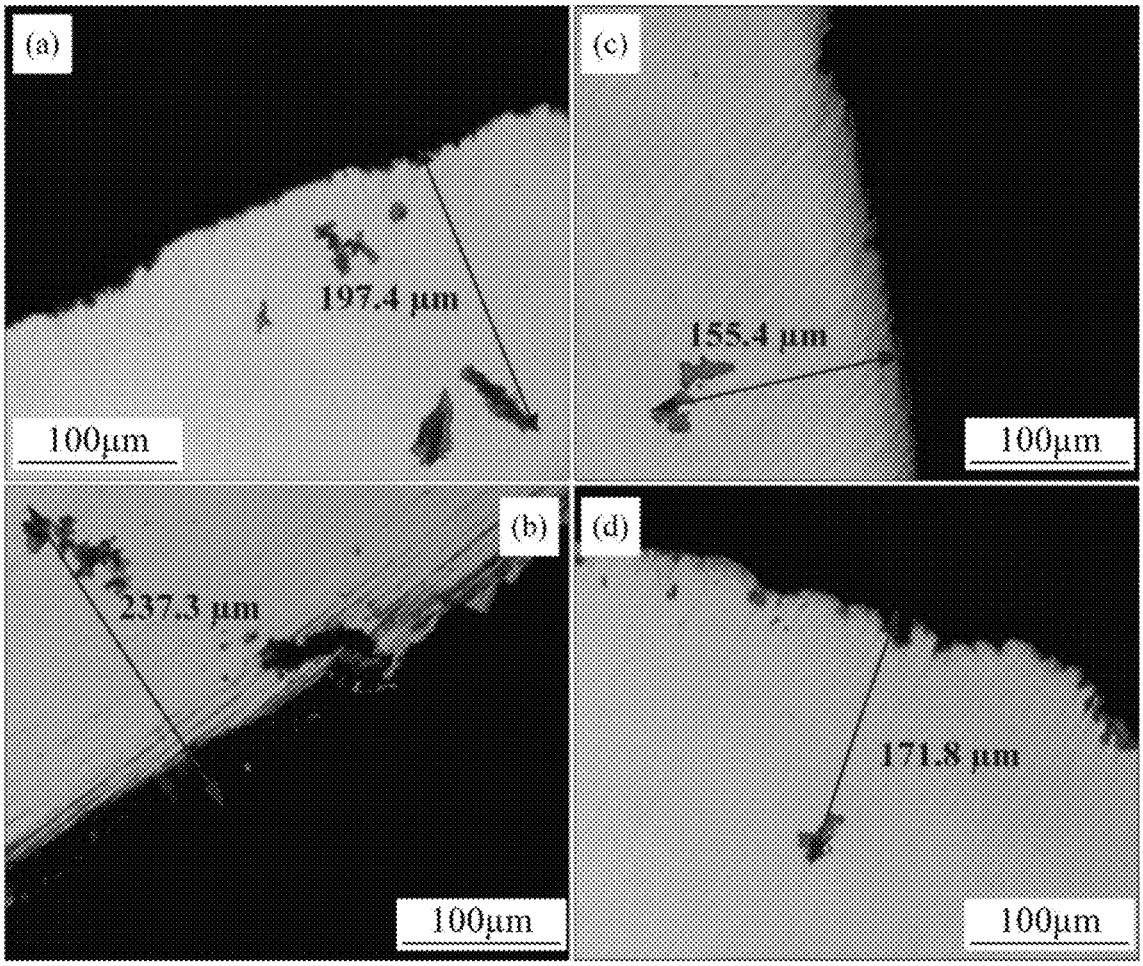
FIG. 5 shows the typical cross-sectional corrosion morphologies of specimens after the ant-nest corrosion of Example 2 and Comparative Example 1 of the present application, and provides the corrosion depth, wherein FIG. 5 (*a*) is the cross-sectional morphology of the specimen after the ant-nest corrosion test of Comparative Example 1.

Examples 12-15 demonstrate that, by comprehensively adjusting the contents of Sn, Ni, P, Zr, Co, and B while maintaining both f1 and f2 values at optimal levels, the comprehensive performance of the copper alloy tube can be effectively improved by using the repeated recrystallization process. Compared with Comparative Example 1, the tensile strength of Example 12 is increased by approximately 27.6% (see FIG. 4), and the copper alloy tube has a yield-to-tensile ratio of not higher than 0.25 and excellent formability. The burst pressure increases by 30% or more, while the burst pressure decay rate after tube welding is less than 2%. Under identical testing conditions, the maximum corrosion depth of a single tube is less than 150 μm, and a maximum corrosion depth at a bent portion is less than 160 μm. The XRD pattern demonstrates that reasonably controlling the contents of Zr, Co, and B can ensure that the copper alloy forms a single α phase solid solution without hard and brittle second phase precipitation (see FIG. 2). The contents of Sn and Ni in Example 12 are basically the same as those in Example 2, but the contents of Zr, Co and B are significantly higher. The addition of Zr is beneficial to offset the hardening effect caused by Ni, Co and B elements, and enables the copper alloy to have a high total proportion of Σ3, 29, and Σ27 boundaries, so that the copper alloy maintains a low yield-to-tensile ratio of 0.25. Co is beneficial to improve the high-temperature softening resistance of the copper alloy, and due to the effect of Co, the burst pressure decay rate of Example 12 is only 1.8%. B mainly improves the quality of the ingot and reduces the oxygen content, ensuring the successful preparation of low-oxygen copper alloy materials without casting defects by using existing equipment.

Example 16 demonstrates that the high-performance copper alloy tube and the combined recrystallization treatment process of the present application can be applied to the preparation of internally threaded tubes, and the various performance indexes thereof can achieve the expected effect.

Figure 3:
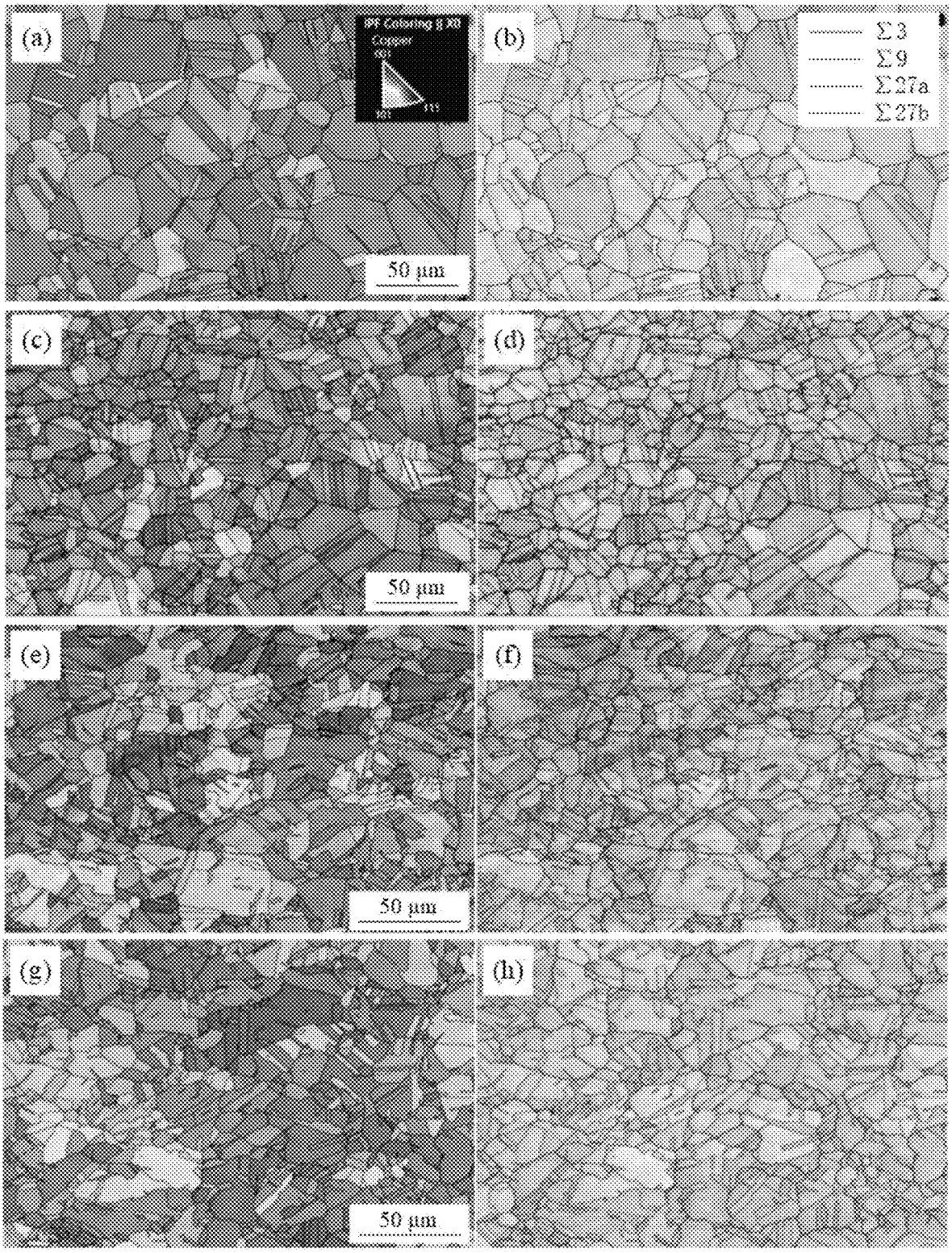
FIG. 3 shows the inverse pole figure (IPF) and grain boundary distribution diagram of the specimen of Example 2, the specimen of Example 5 after three cycles of repeated recrystallization, the specimen of Example 5 after four cycles of repeated recrystallization and the specimen of Comparative Example 1 of the present application obtained by electron backscatter diffraction (EBSD) test, wherein FIG. 3(*a*) is the IPF of Comparative Example 1.

Table 4 and FIG. 3 demonstrate that the number of recrystallization cycles of the repeated recrystallization process route has a significant effect on the proportions of Σ3, Σ9, and Σ27 coincidence site lattice grain boundaries. By analyzing the grain boundary distribution diagram of the specimens of Example 5, 13, 15 after 3 and 4 cycles of repeated recrystallization, it can be seen that increasing the number of recrystallization cycles can not only increase the proportion of Σ3 coincidence site lattice grain boundary but also significantly raise the proportions of Σ9, Σ27a, and Σ27b coincidence site lattice grain boundaries. This increases the (Σ9+Σ27)/Σ3 ratio and reduces the connectivity of the random high-angle grain boundary network. However, obviously, when the number of cycles is too low, such as less than 3 recrystallization cycles, the comprehensive performance and cost balance benefits brought by the repeated recrystallization process will not be as good as the single recrystallization process. Similarly, after the number of cycles reaches 6, the proportion of low-Σ value coincidence site lattice grain boundaries to be saturated, and even if the recrystallization cycle is performed again, it is difficult to increase the total proportion of Σ3, Σ9, and Σ27 boundaries, therefore, after the number of cycles exceeds 6, the comprehensive performance and cost balance benefits brought by the repeated recrystallization process are not as good as the repeated recrystallization process with the number of cycles between 3-6.

Finally, it should be noted that the above Examples are only used to illustrate the technical solutions of the present application, but not to limit them; although the present application has been described in detail with reference to the foregoing Examples, those of ordinary skill in the art should understand that they can still modify the technical solutions described in the foregoing Examples, or equivalently replace some or all of the technical features; and these modifications or replacements do not make the essence of the corresponding technical solutions depart from the scope of the technical solutions of the Examples of the present application.

TABLE 1

The chemical composition of Examples 1-16

| | Chemical composition of copper alloy, the balance being Cu and impurities | | | | | | | | |
|---|---|---|---|---|---|---|---|---|---|
| Alloy Number | Ni/% | Sn/% | P/% | Zr/% | Co/% | B/% | O/% | f1/% | f2 |
| Example 1 | 0.08 | 0.21 | 0.030 | — | — | — | 0.0017 | 0.51 | 2.63 |
| Example 2 | 0.10 | 0.36 | 0.031 | — | — | — | 0.0016 | 0.67 | 3.60 |
| Example 3 | 0.12 | 0.58 | 0.022 | — | — | — | 0.0019 | 0.80 | 4.83 |
| Example 4 | 0.25 | 0.35 | 0.029 | — | — | — | 0.0015 | 0.64 | 1.40 |
| Example 5 | 0.10 | 0.34 | 0.031 | — | — | — | 0.0016 | 0.65 | 3.40 |
| Example 6 | 0.12 | 0.58 | 0.022 | — | — | — | 0.0019 | 0.80 | 4.83 |
| Example 7 | 0.10 | 0.36 | 0.031 | 0.0032 | 0.0036 | — | 0.0018 | 0.70 | 3.60 |
| Example 8 | 0.11 | 0.55 | 0.027 | 0.0034 | 0.0035 | — | 0.0017 | 0.85 | 5.00 |
| Example 9 | 0.10 | 0.35 | 0.030 | 0.0125 | 0.0092 | — | 0.0015 | 0.78 | 3.50 |
| Example 10 | 0.12 | 0.58 | 0.025 | 0.0126 | 0.0089 | — | 0.0016 | 0.96 | 4.83 |
| Example 11 | 0.11 | 0.36 | 0.030 | 0.0035 | 0.0036 | 0.0023 | 0.0008 | 0.70 | 3.27 |
| Example 12 | 0.10 | 0.36 | 0.031 | 0.0032 | 0.0036 | — | 0.0018 | 0.70 | 3.60 |
| Example 13 | 0.28 | 0.55 | 0.029 | 0.0278 | 0.0087 | — | 0.0017 | 1.12 | 1.96 |
| Example 14 | 0.22 | 0.58 | 0.029 | 0.0125 | 0.0035 | 0.0052 | 0.0008 | 1.00 | 2.64 |
| Examples 15-16 | 0.28 | 0.55 | 0.025 | 0.0275 | 0.0089 | 0.0095 | 0.0007 | 1.08 | 1.96 |

TABLE 2

The chemical composition of Comparative Examples 1-8

| | Chemical composition of copper alloy, the balance being Cu and impurities | | | | | | | | |
|---|---|---|---|---|---|---|---|---|---|
| Alloy Number | Ni/% | Sn/% | P/% | Zr/% | Co/% | B/% | O/% | f1/% | f2 |
| Comparative Example 1 | — | — | 0.028 | — | — | — | 0.0018 | 0.28 | — |
| Comparative Example 2 | — | — | 0.031 | — | — | — | 0.0017 | 0.31 | — |
| Comparative Example 3 | 0.10 | 0.72 | 0.022 | — | — | — | 0.0017 | 0.94 | 7.20 |
| Comparative Example 4 | 0.39 | 0.12 | 0.027 | — | — | — | 0.0019 | 0.39 | 0.31 |
| Comparative Example 5 | 1.21 | 0.36 | 0.025 | — | — | — | 0.0016 | 0.61 | 0.30 |
| Comparative Example 6 | 0.09 | 1.32 | 0.026 | — | — | — | 0.0017 | 1.58 | 14.67 |
| Comparative Example 7 | 0.12 | 0.29 | 0.030 | 0.0514 | 0.0316 | — | 0.0021 | 1.10 | 2.42 |
| Comparative Example 8 | 0.09 | 0.35 | 0.025 | 0.0545 | 0.0520 | 0.0499 | 0.0006 | 1.15 | 3.89 |

TABLE 3

The proportion of the low-Σ value coincidence site lattice grain boundaries and average grain size of the copper alloys in the Examples and Comparative examples

| Alloy Number | The proportion of the low-Σ value coincidence site lattice grain boundaries/% | Average grain size (excluding twin boundaries)/μm | Average grain size (including twin boundaries)/μm |
|---|---|---|---|
| Example 1 | 57.36 | 18 | 12 |
| Example 2 | 61.12 | 16 | 11 |
| Example 3 | 62.97 | 18 | 14 |
| Example 4 | 57.42 | 15 | 12 |
| Example 5 | 72.80 | 18 | 10 |
| Example 6 | 74.21 | 17 | 9 |
| Example 7 | 61.22 | 16 | 12 |
| Example 8 | 63.15 | 14 | 10 |
| Example 9 | 61.77 | 15 | 10 |
| Example 10 | 63.45 | 17 | 11 |
| Example 11 | 61.31 | 16 | 11 |
| Example 12 | 75.34 | 18 | 11 |
| Example 13 | 78.89 | 14 | 8 |
| Example 14 | 77.62 | 18 | 10 |
| Example 15 | 76.44 | 17 | 9 |
| Example 16 | 76.32 | 18 | 9 |
| Comparative Example 1 | 42.29 | 22 | 16 |
| Comparative Example 2 | 40.75 | 23 | 16 |
| Comparative Example 3 | 63.11 | 15 | 11 |
| Comparative Example 4 | 39.38 | 16 | 12 |

TABLE 4

The proportion detailed table of low-Σ value coincidence site lattice grain boundaries in the copper alloys from the Examples and Comparative examples, as well as the effect of the number of cycles in the repeated recrystallization process on the proportion of coincidence site lattice grain boundaries

| Alloy Number | Recrystallization Process | Σ3/% | Σ9/% | Σ27a/% | Σ27b/% | (Σ9 + Σ27)/Σ3/% |
|---|---|---|---|---|---|---|
| Example 1 | Single Recrystallization | 55.4 | 1.10 | 0.44 | 0.42 | 3.5 |
| Example 2 | Single Recrystallization | 58.6 | 1.28 | 0.63 | 0.61 | 4.3 |
| Example 3 | Single Recrystallization | 60.1 | 1.34 | 0.80 | 0.73 | 4.8 |
| Example 5 | Repeated Recrystallization-3 Cycles | 61.7 | 5.02 | 1.24 | 0.99 | 11.8 |
| Example 5 | Repeated Recrystallization-4 Cycles | 64.7 | 5.52 | 1.35 | 1.23 | 12.5 |
| Example 9 | Single Recrystallization | 59.1 | 1.40 | 0.65 | 0.62 | 4.5 |
| Example 13 | Repeated Recrystallization-3 Cycles | 65.1 | 5.87 | 1.48 | 1.18 | 13.1 |
| Example 13 | Repeated Recrystallization-4 Cycles | 69.6 | 6.47 | 1.60 | 1.22 | 13.3 |
| Example 15 | Repeated Recrystallization-3 Cycles | 64.7 | 5.42 | 1.36 | 0.99 | 12.0 |
| Example 15 | Repeated Recrystallization-4 Cycles | 67.6 | 5.88 | 1.65 | 1.31 | 13.1 |
| Comparative Example 1 | — | 41.1 | 0.93 | 0.12 | 0.14 | 2.9 |

TABLE 5

The mechanical properties, burst pressure, and formability of the copper alloys from the Examples and Comparative examples

| Alloy Number | Yield Strength/ MPa | Tensile Strength/ MPa | Elongation after fracture/ % | yield-to-tensile ratio | Burst Pressure/ MPa | Burst pressure after tube welding/ MPa | Burst Pressure Decay Rate/ % | Bending Test | Flaring Test |
|---|---|---|---|---|---|---|---|---|---|
| Example 1 | 69 | 260 | 55.2 | 0.27 | 26.4 | 24.5 | 7.2 | ○ | ○ |
| Example 2 | 71 | 273 | 54.2 | 0.26 | 28.1 | 26.2 | 6.8 | ○ | ○ |

TABLE 5-continued

The mechanical properties, burst pressure, and formability of the copper alloys from the Examples and Comparative examples

| Alloy Number | Yield Strength/MPa | Tensile Strength/MPa | Elongation after fracture/% | yield-to-tensile ratio | Burst Pressure/MPa | Burst pressure after tube welding/MPa | Burst Pressure Decay Rate/% | Bending Test | Flaring Test |
|---|---|---|---|---|---|---|---|---|---|
| Example 3 | 73 | 281 | 52.2 | 0.26 | 29.7 | 27.7 | 6.7 | ○ | ○ |
| Example 4 | 72 | 277 | 51.8 | 0.26 | 29.2 | 27.2 | 6.8 | ○ | ○ |
| Example 5 | 72 | 285 | 52.6 | 0.25 | 30.8 | 29.8 | 3.2 | ○ | ○ |
| Example 6 | 73 | 289 | 51.8 | 0.25 | 31.4 | 30.5 | 2.9 | ○ | ○ |
| Example 7 | 70 | 277 | 54.1 | 0.25 | 29.3 | 27.8 | 5.1 | ○ | ○ |
| Example 8 | 75 | 286 | 54.3 | 0.26 | 31.0 | 29.7 | 4.2 | ○ | ○ |
| Example 9 | 71 | 281 | 55.1 | 0.25 | 30.2 | 28.9 | 4.3 | ○ | ○ |
| Example 10 | 72 | 291 | 54.9 | 0.25 | 31.8 | 30.6 | 3.8 | ○ | ○ |
| Example 11 | 72 | 278 | 53.9 | 0.26 | 29.6 | 28.2 | 4.7 | ○ | ○ |
| Example 12 | 73 | 296 | 51.6 | 0.25 | 32.5 | 31.9 | 1.8 | ○ | ○ |
| Example 13 | 76 | 309 | 50.3 | 0.25 | 34.0 | 33.7 | 0.9 | ○ | ○ |
| Example 14 | 75 | 303 | 50.6 | 0.25 | 33.5 | 33.0 | 1.5 | ○ | ○ |
| Example 15 | 76 | 310 | 51.6 | 0.25 | 34.8 | 34.4 | 1.1 | ○ | ○ |
| Example 16 | 75 | 308 | 51.9 | 0.24 | 19.7 | 19.5 | 1.0 | ○ | ○ |
| Comparative Example 1 | 71 | 232 | 52.0 | 0.31 | 24.6 | 20.9 | 15.0 | ○ | ○ |
| Comparative Example 2 | 70 | 230 | 52.4 | 0.30 | 14.3 | 11.8 | 17.5 | ○ | ○ |
| Comparative Example 3 | 92 | 287 | 46.3 | 0.32 | — | — | — | ○ | x |
| Comparative Example 4 | 86 | 264 | 41.1 | 0.33 | — | — | — | ○ | x |
| Comparative Example 5 | 122 | 307 | 31.1 | 0.40 | — | — | — | x | x |
| Comparative Example 6 | 117 | 298 | 36.6 | 0.39 | — | — | — | x | x |
| Comparative Example 7 | 106 | 285 | 29.3 | 0.37 | — | — | — | x | x |
| Comparative Example 8 | 122 | 284 | 25.6 | 0.43 | — | — | — | x | x |

Note:

"○" represents qualified; "x" represents unqualified; "—" represents that the item has no data or the test has not failed.

TABLE 6

The ant-nest corrosion resistance of the copper alloys from the Examples and Comparative examples

| Alloy Number | Single-tube maximum corrosion depth/μm | Improvement in single tube corrosion resistance relative to TP2 copper/% | Maximum corrosion depth at a bent portion/μm | Corrosion resistance decay rate at a bent portion/% |
|---|---|---|---|---|
| Example 1 | 165.8 | 15.8 | 185.9 | 12.1 |
| Example 2 | 161.7 | 17.9 | 178.7 | 10.5 |
| Example 3 | 154.6 | 21.5 | 167.3 | 8.2 |
| Example 4 | 147.4 | 25.1 | 164.4 | 11.5 |
| Example 5 | 152.1 | 22.8 | 161.6 | 6.2 |
| Example 6 | 150.5 | 23.6 | 159.5 | 6.0 |
| Example 7 | 160.1 | 18.7 | 176.5 | 10.2 |
| Example 8 | 157.3 | 20.1 | 170.5 | 8.4 |
| Example 9 | 158.6 | 19.5 | 173.7 | 9.5 |
| Example 10 | 152.2 | 22.7 | 164.3 | 8.0 |
| Example 11 | 150.6 | 23.5 | 164.4 | 9.2 |
| Example 12 | 149.4 | 24.1 | 158.2 | 5.9 |
| Example 13 | 145.5 | 26.1 | 150.6 | 3.5 |
| Example 14 | 142.8 | 27.5 | 147.9 | 3.6 |
| Example 15 | 136.1 | 30.9 | 141.8 | 4.2 |
| Example 16 | 137.2 | 31.8 | 143.0 | 4.2 |
| Comparative Example 1 | 196.9 | — | 231.2 | 17.4 |
| Comparative Example 2 | 201.3 | — | 237.7 | 18.1 |

What is claimed is:

1. A high-performance copper alloy tube, consisting of the following components in mass percentage: 0.05%≤Sn≤0.6%, 0.08%≤Ni≤0.12%, 0.015%≤P≤0.045%, and the balance being Cu and unavoidable impurities; and f1=[Sn]+10[P], f2=[Sn]/[Ni], f1 and f2 satisfying: 0.5%≤f1≤1.05%, 1<f2≤5, wherein [Sn], [P] and [Ni] represent the mass percentage content of Sn, P and Ni, respectively; the copper alloy tube has a single face-centered cubic crystal structure α phase; the average grain size excluding twin boundaries is 10-25 μm, and the average grain size including twin boundaries is 5-20 μm; the total proportion of Σ3, Σ9, and Σ27 coincidence site lattice grain boundaries in the copper alloy tube is ≥50%, and the ratio of the proportions of Σ9 and Σ27 coincidence site lattice grain boundaries to that of ≥3 coincidence site lattice grain boundaries satisfies: (Σ9+Σ27)/Σ3≥3.5%.

2. The high-performance copper alloy tube according to claim 1, wherein the copper alloy tube has a tensile strength of ≥260 MPa, a yield-to-tensile ratio of 0.23-0.30, and a burst pressure decay rate of ≤10%; after alternating hot and cold corrosion tests for 21 days in an atmosphere of 0.4% formic acid aqueous solution, a maximum corrosion depth of a single tube is ≤170 μm, and a maximum corrosion depth at a bent portion is ≤190 μm.

3. The high-performance copper alloy tube according to claim 1, consisting of the following components in mass percentage: 0.05%≤Sn≤0.6%, 0.08%≤Ni≤0.12%, 0.015%≤P≤0.045%, and the balance being Cu and unavoidable impurities; and f1=[Sn]+10 [P], f2=[Sn]/[Ni], f1 and f2 satisfying: 0.5%≤f1≤1.05%, 1<f2≤5, wherein [Sn], [P] and [Ni] represent the mass percentage content of Sn, P and Ni, respectively;

the copper alloy tube has a single face-centered cubic crystal structure α phase; the average grain size excluding twin boundaries is 10-25 μm, and the average grain size including twin boundaries is 5-20 μm; the total proportion of Σ3, Σ9, and Σ27 coincidence site lattice grain boundaries in the copper alloy tube is ≥68%, and the ratio of the proportions of Σ9 and Σ27 coincidence site lattice grain boundaries to that of Σ3 coincidence site lattice grain boundaries satisfies: (Σ9+Σ27)/Σ3≥10%.

4. The high-performance copper alloy tube according to claim 3, wherein the copper alloy tube has a tensile strength of ≥285 MPa, a yield-to-tensile ratio of 0.21-0.28, and a burst pressure decay rate of ≤5%; after alternating hot and cold corrosion tests for 21 days in an atmosphere of 0.4% formic acid aqueous solution, a maximum corrosion depth of a single tube is ≤155 μm, and a maximum corrosion depth at a bent portion is ≤165 μm.

5. A preparation method of the high-performance copper alloy tube according to claim 1, comprising the following:

batching and smelting: smelting the raw materials meeting the content and ratio;

continuous casting: continuously casting the molten liquid to obtain a billet;

rolling: rolling the billet to obtain a rolled tube blank;

combined drawing: reducing the diameter of the rolled tube blank;

recrystallization treatment: obtaining a product with target properties by controlling the deformation amount and annealing parameters.

6. The preparation method of the high-performance copper alloy tube according to claim 5, wherein the recrystallization treatment is a single recrystallization process, which is "block drawing→final annealing" with a total deformation amount of block drawing not less than 80%, a final annealing temperature of 500-750° C., and an annealing time of 30-150 min.

7. The preparation method of the high-performance copper alloy tube according to claim 5, wherein the recrystallization treatment is repeated recrystallization, which is performed for multiple cycles of "block drawing→annealing" after 1-3 passes of block drawing, with a total deformation amount of the 1-3 passes of block drawing before the cycles ≤72%; in the multiple cycles of "block drawing→annealing", a number of cycles is 3-6, a deformation amount of block drawing per cycle is 25-35%, an annealing temperature is 500-600° C., and an annealing time is 10-70 min.

8. The high-performance copper alloy tube according to claim 1, wherein 0.21%≤Sn≤0.58%.

9. The high-performance copper alloy tube according to claim 1, wherein 0.08%≤Ni≤0.10%.

10. The high-performance copper alloy tube according to claim 1, wherein 0.21%≤Sn≤0.36%, 0.10%≤Ni≤0.12%.

11. The high-performance copper alloy tube according to claim 1, wherein Sn: 0.34%, Ni: 0.10%, P: 0.031%.

12. The high-performance copper alloy tube according to claim 1, wherein 0.05%≤Sn≤0.36%.

13. The high-performance copper alloy tube according to claim 1, wherein 0.21%≤Sn≤0.36%.

* * * * *